United States Patent [19]

Mowatt-Larssen

[11] 4,304,271

[45] Dec. 8, 1981

[54] TANK CAR AND TRAIN THEREOF AND LOADING AND UNLOADING SYSTEMS

[75] Inventor: Erling Mowatt-Larssen, Warren, Ohio

[73] Assignee: General American Transportation Corporation, Chicago, Ill.

[21] Appl. No.: 123,202

[22] Filed: Feb. 21, 1980

[51] Int. Cl.[3] ..... B65B 31/00; F17D 1/00

[52] U.S. Cl. ..... 141/35; 137/575; 141/98; 141/198

[58] Field of Search ..... 105/358, 360; 137/1, 137/572, 575; 141/1, 2, 35, 36, 98, 231-233, 198

[56] References Cited

U.S. PATENT DOCUMENTS

| | | | |
|---|---|---|---|
| 1,542,116 | 6/1925 | Welcker | 137/572 X |
| 3,675,670 | 7/1972 | Ogawa | 141/35 X |
| 3,722,556 | 3/1973 | Jeffers | 141/2 |
| 3,897,807 | 8/1975 | Hurst et al. | 141/98 |
| 4,002,192 | 1/1977 | Mowatt-Larssen | 141/35 |
| 4,007,766 | 2/1977 | Hurst | 141/35 |
| 4,008,739 | 2/1977 | Hurst et al. | 141/35 |

*Primary Examiner*—Frederick R. Schmidt

*Attorney, Agent, or Firm*—Dithmar, Stotland, Stratman & Levy

[57] ABSTRACT

A railway train including a plurality of interconnected tank cars, each car comprising a tank with a lading conduit extending the length thereof and having first and second pipes communicating with the interior of the tank with one of the pipes extending to the bottom of the tank and the other terminating adjacent to the top of the tank, the lading conduits of adjacent cars being interconnected by flexible connecting conduits; valve mechanism in the lading conduits and the first and second pipes for closing the lading conduit between the first and second pipes and opening the first and second pipes during loading of fluid lading into the tank and during unloading of fluid lading from the tank and for closing the first and second pipes during transporting of the tank; also disclosed is a loading system and an unloading system for a train of such tank cars.

66 Claims, 20 Drawing Figures

TANK CAR AND TRAIN THEREOF AND LOADING AND UNLOADING SYSTEMS

PRIOR ART STATEMENT AND BACKGROUND OF THE INVENTION

The present invention relates to railway tank cars, and particularly such tank cars adapted for interconnection to accommodate loading and unloading of a train of interconnected cars without movement thereof, structure being provided for singly and sequentially loading the tank cars with fluid lading and singly and sequentially unloading the tank cars of fluid lading, and loading and unloading systems for a train of such tank cars.

The concept of providing fluid communication among a series of interconnected railway tank cars is disclosed in the prior art, but previous systems have failed to provide a valve mechanism and control system therefor useful during loading and unloading of fluid ladings that would safely handle certain types of fluid ladings such as compressed liquified gases, and particularly liquified petroleum gases. For example, prior U.S. Pat. No. 3,897,807 granted Aug. 5, 1975 to D. Hurst and myself discloses a unit train of tank cars with the tanks thereof connected in series, and also discloses in FIGS. 16 to 19A thereof a train of tank cars wherein the individual tanks are connected by input-output conduits 320 and bypass pipe sections 330 with control valves 335 therein, whereby the individual tanks in the unit train can be filled either serially, i.e., one after the other with fluid ladings flowing sequentially through each of the tanks, or alternatively, the tanks can be loaded in parallel thus permitting substantially simultaneous loading of the tanks. When handling certain fluid ladings, such as liquified petroleum gases, such loading and unloading procedures are not practicable and present safety hazards.

U.S. Pat. No. 1,542,116 granted June 16, 1925 to R. Welcker discloses railway tank cars for interconnection in a manifolded arrangement to accommodate continuous emptying of the interconnected tanks from a single location, without moving or disconnecting the cars. However, the arrangement of the Welcker patent does not provide for continuous loading of the interconnected tanks from a single location in a sequential manner, and the inter-tank lading connections are along the longitudinal axes of the tanks which is found to be a disadvantageous arrangement.

U.S. Pat. No. 3,675,670 granted July 11, 1972 to O. Ogawa shows railway tank cars for interconnection in a manifolded arrangement to accommodate continuous loading and unloading of the interconnected tanks from a single location. However, the tank cars of the Ogawa patent are not suitable for handling of liquified petroleum gases, and the like, and would present hazards in the loading operation and the unloading operation and also during transportation of the loaded tank cars.

U.S. Pat. No. 3,722,556 granted Mar. 27, 1973 to W. Jeffers and J. M. Jeffers discloses a manifolded tank arrangement which accommodates both loading and unloading of a string of interconnected tank cars from a single location, but provides the inter-tank lading connections at the bottom of the tanks, and provides exposed and unprotected lading flow control valves whereby to present a substantial safety hazard during transport of the tank cars.

While the tank car, the loading system and the unloading system of the present invention can be utilized with various liquid ladings or commodities, the tank car and the loading and unloading systems are primarily intended for use in the transportation of liquified compressed gases, and specifically liquified petroleum gases, wherein safety is of paramount importance. The present invention provides a system wherein in the normal loading operation of a string or train of tank cars, only a single tank car will be in liquid communication with the lading conduit or loading line at any one time; likewise, in the normal unloading operation of a string of tank cars, only a single tank car will be in liquid communication with the lading conduit or unloading line at any one time. More specifically during the loading operation, the gas or vapors that remain in the as yet unloaded tank cars are pushed through the tank cars serially while the liquid lading is loaded into the tank cars singly and in sequence, and actually in parallel one with the other but singly. In the unloading of a train of the tank cars, the compressed gas used to unload the tank cars is pushed through the tank cars in series so as to provide for maximum ventilation thereof, while the liquid lading is removed from the tank cars singly and sequentially and therefore in parallel but singly. This arrangement provides safety in the case of rupture of one of the conduits during the loading or unloading since but a single car is exposed at any one time to the dangerous liquid lading. There also is a minimum pressure drop in the system during the loading and unloading operations since only a single tank car is loaded or unloaded at any one time. All this is accomplished while providing a system that is compatible with the present transportation systems for such liquified compressed gases.

The prior art on the other hand provides systems wherein there is a significant pressure drop along the loading and unloading conduits since the tank cars are essentially connected in series during both the loading and unloading operations. Rupture in the loading line or the unloading line of the prior art structures provides a more serious safety hazard when all the tank cars are serially connected since there is no reservoir to receive lading in the event of rupture of one of the conduits.

The arrangement of the present invention provides a safer system in that a minimal number of controls are required for the system, and a minimum number of openings are required into each tank car. In the prior art on the other hand, there were in general more openings required and more controls required, whereby more protective structure must be provided therefor.

As will appear more fully hereinafter, the electrical-pneumatic control system for the present invention includes a pneumatic accumulator which provides a fail-safe reservoir for operating the various control valves to close off the tank cars and the lading conduits in the event of the breaking of any of the pneumatic lines. The accumulator is incorporated in the system so as automatically to close the valves in the lading conduit upon completion of the loading of the tank cars and to close the valves for the pipes leading into the tank cars upon completion of the unloading of the tank cars.

An additional safety feature resides in the provision of a system wherein the failure of any electronic component in a single tank car will not disrupt the loading procedure but enables continued loading of the next and subsequent tank cars in a train of the tank cars. More specifically, upon the failure of an electronic component of the second car in a string of tank cars so that the second tank car is not in readiness for loading or in the event of failure of any of the valving in the second tank car which would prevent loading thereof, the lading conduit across the second tank car is still open and loading can proceed with the third tank car or any subsequent tank car which is in condition for loading. Each of the control valves on the tank cars includes a position indicator so that the operator can immediately detect that one of the tank cars is not operating properly and can take steps thereafter to repair or remedy the malfunction on the second tank car, for example, while loading proceeds with subsequent tank cars. As soon as the second tank car is repaired and placed in operative condition again, loading of that tank car can proceed without interruption of the loading operation.

SUMMARY OF THE INVENTION

The present invention provides a railway tank car for unit train service which permits a train of such cars to be loaded or unloaded without movement thereof from a single location, and accommodates sequential loading and unloading of fluid ladings, all with safety and with improved economy of time and manpower.

This is accomplished in the present invention, and it is an object of the present invention to accomplish these desired results by providing a railway tank car of the character described which includes a tank for holding fluid ladings, a wheeled chassis structure mounting the tank with chassis coupling means for coupling to the chassis of associated cars, a lading conduit on the tank extending substantially the length thereof and having coupling means at the ends thereof for coupling to associated flexible connecting conduits to place the lading conduit in fluid communication with the lading conduits of adjacent like cars, a first pipe in communication with the lading conduit extending into the tank and terminating at an open end adjacent to the bottom of the tank, a second pipe in communication with the lading conduit at a point spaced from the first pipe and extending into the tank, and valve mechanism in the lading conduit and the first and second pipes for closing the lading conduit between the first and second pipes and opening the first and second pipes to accommodate loading of fluid lading into the tank and to accommodate unloading of fluid lading from the tank and for closing the first and second pipes for transporting of the tank.

Another object of the invention is to provide a railway tank car of the type set forth wherein the valve mechanism includes a first control valve for selectively opening and closing the lading conduit, a second control valve for selectively opening and closing the first pipe, a third control valve for selectively opening and closing the second pipe, and valve control mechanism operatively connected to the control valves for closing the first control valve and opening the second and third control valves to accommodate loading of fluid lading into the tank and to accommodate unloading of fluid lading from the tank and for closing the first and second and third control valves for transporting of the tank.

Yet another object of the invention is to provide a railway tank car of the type set forth wherein the valve mechanism includes a first control valve for opening and closing the lading conduit and the first pipe, a second control valve for opening and closing the lading conduit and the second pipe, and valve control mechanism operatively connected to the control valves for actuating the control valves to close the lading conduit between the first and second pipes and to open the first and second pipes to accommodate loading of fluid lading into the tank and to accommodate unloading of fluid lading from the tank and for closing the first and second pipes for transporting of the tanks.

Still another object of the invention is to provide a railway tank car train made up of interconnected railway tank cars of the type set forth, wherein the individual tanks are singly and sequentially loaded with fluid ladings and are singly and sequentially unloaded of fluid lading through the free end of the lading conduit on the tank car on one end of the train.

Yet another object of the invention is to provide a railway tank car and a train of such tank cars which is particularly adapted and arranged for the handling of liquified gases, particularly liquified petroleum gases, with safety during the loading and unloading and transportation thereof.

A further object of the invention is to provide a loading system for railway tank car trains of the type set forth for singly and sequentially loading the tank cars with fluid lading.

A still further object of the invention is to provide an unloading system for railway tank car trains of the type set forth for singly and sequentially unloading the tank cars of fluid lading.

Further features of the invention pertain to the particular arrangement of the parts of the railway tank cars and the trains made up of such tank cars, whereby the above outlined and additional operating features thereof are attained.

The invention, both as to its organization and method of operation, together with further features and advantages thereof will best be understood with reference to the following specification taken in connection with the accompanying drawings.

DESCRIPTION OF THE PREFERRED EMBODIMENTS

Figure 1:
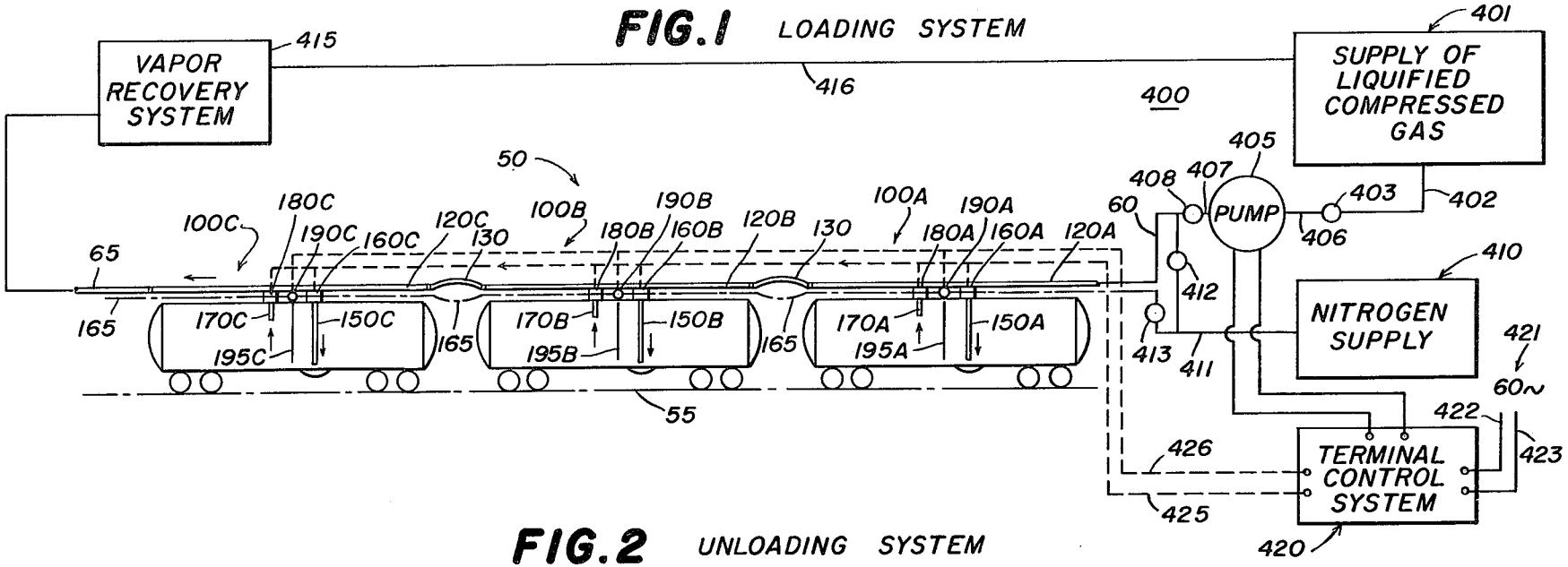
FIG. 1 is a diagrammatic view of a loading system for loading fluid ladings into a string of tank cars, the system being made in accordance with and embodying the features of the present invention.
Figure 2:
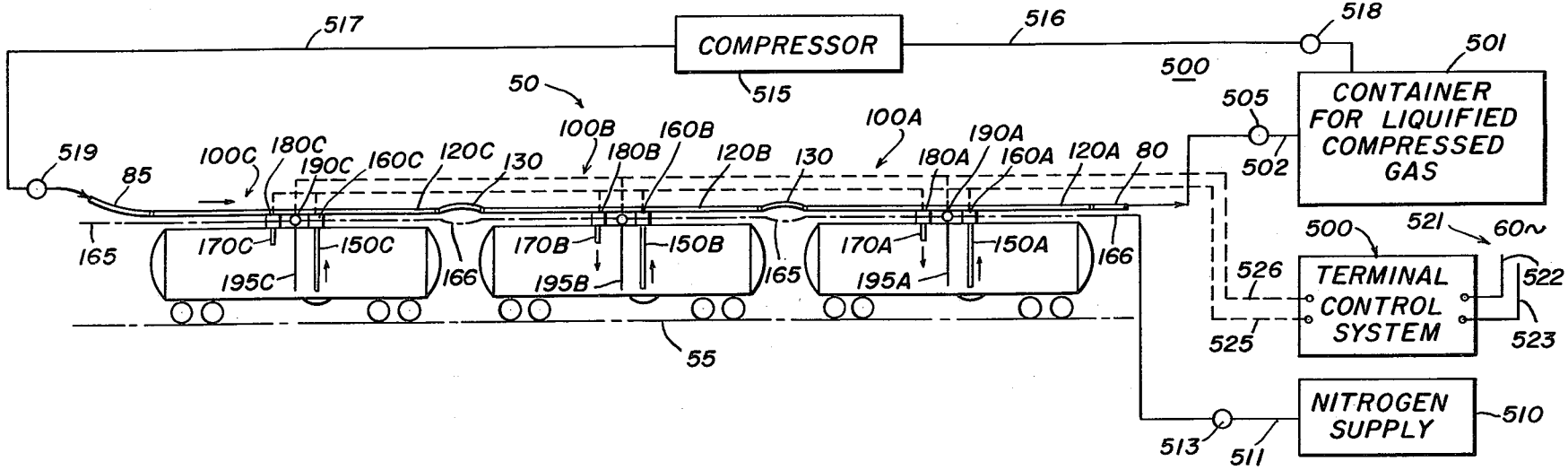
FIG. 2 is a diagrammatic illustration of an unloading system for unloading fluid ladings from a string of tank cars, the system being made in accordance with and embodying the features of the present invention.

There is illustrated in FIG. 1 of the drawings a loading system generally designated by the numeral 400 for loading fluid ladings, such as compressed liquified gases, into a string of three tank cars generally designated by the numerals 100A, 100B and 100C. An unloading system generally designated by the numeral 500 is illustrated in FIG. 2 of the drawings for unloading the string of three tank cars illustrated. The specific construction and operation of the loading system 400 and the unloading system 500 will be discussed hereinafter.

Figure 3:
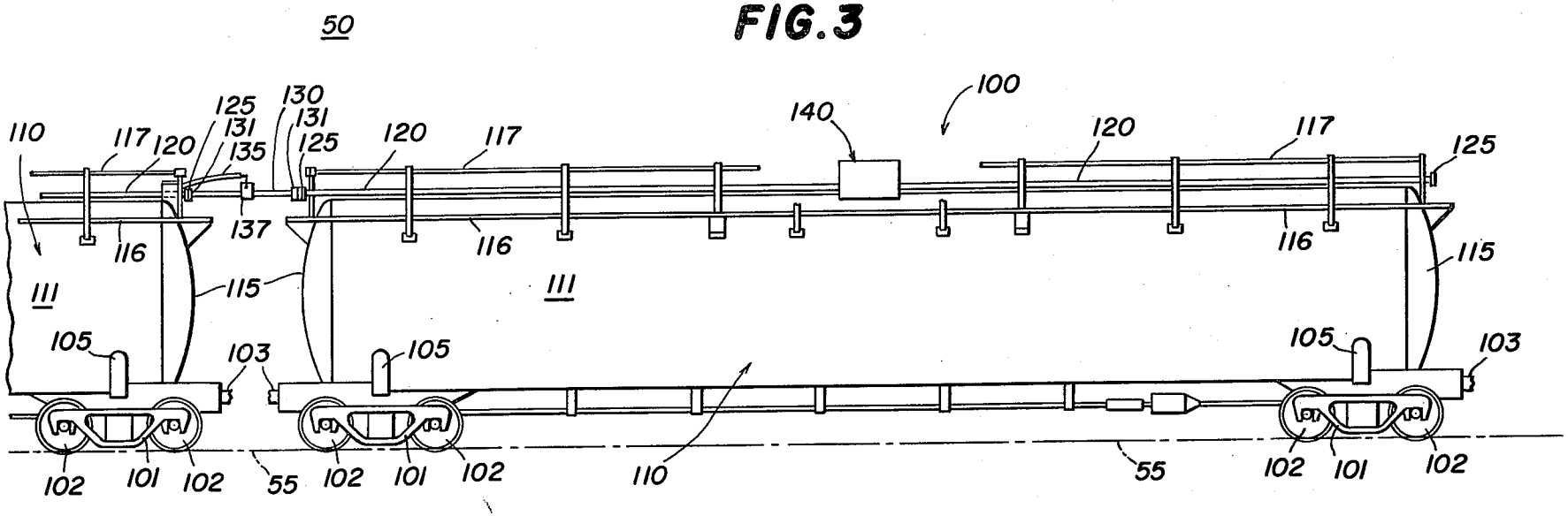
FIG. 3 is a side elevational view of a railway tank car and a portion of a second tank car made in accordance with and embodying the features of the present invention.
Figure 4:
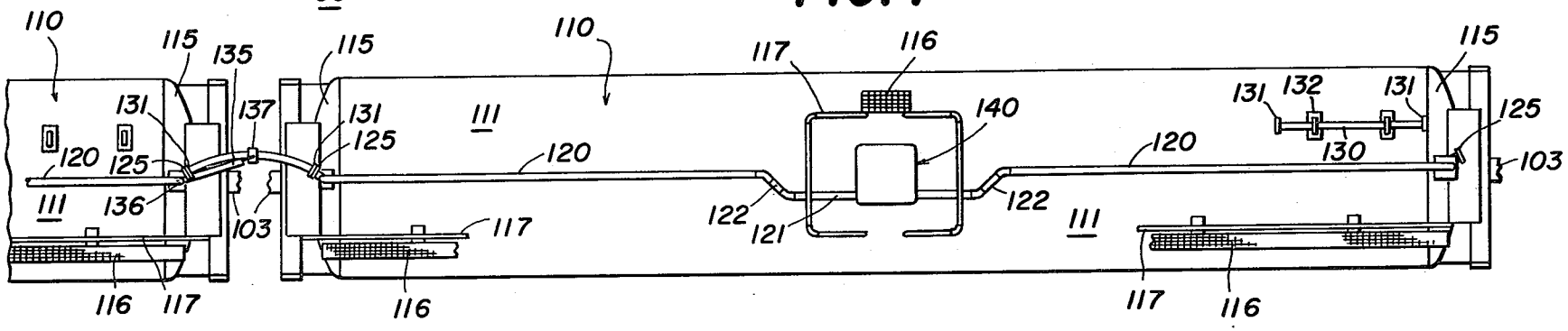
FIG. 4 is a plan view of the railway tank cars illustrated in FIG. 3.

There is illustrated in FIGS. 3 and 4 one of the railway tank cars generally designated by the numeral 100 made in accordance with and embodying the principles of the present invention. A complete tank car 100 and a portion of a second tank car 100 are illustrated connected to form a railway train 50 adapted to be supported by a standard railway track 55. The tank car 100 includes a pair of trucks 101 that provide wheeled chassis structure and include rail wheels 102 engaging on the railway track 55. Couplers 103 are provided at each end of the tank car 100 for connection to like tank cars 100 to form the railway train 50. The trucks 101 support arcuate saddle bolsters 105 that directly support a cylindrical elongated tank 110, the draft forces between the trucks 101 being transmitted through the tank 110.

The tank 110 is essentially circular in cross section and includes a cylindrical shell 111 provided with a sump 112 near the middle thereof and at the bottom thereof (see FIG. 7) for a purpose to be described more fully hereinafter. The ends of the shell 111 are closed by dome-shaped tank heads 115 to provide a fully enclosed tank 110. Mounted on the tank 110 at the upper portion thereof are catwalks designated by the numeral 116 and railings designated by the numeral 117.

Referring particularly to FIG. 4, a lading conduit 120 is provided that extends essentially the length of the tank 110 on the top thereof, the central portion of the lading conduit 120 having an offset section 121 connected thereto by connecting sections 122. Each end of the lading conduit 120 carries a coupling member 125, the ends of the lading conduit 120 terminating inboard of the ends of the associated tank 110. In order to interconnect the lading conduits 120 of adjacent railway tank cars in the train 50, flexible connecting conduits 130 are provoided. It will be understood that other "flexible" connections may be used in place of the connecting conduits 130, other conduit interconnecting means being acceptable so long as they accommodate all of the relative movements between two coupled tank cars in train action. Each of the conduits 130 has coupling means 131 on each end thereof engaging with the coupling means 125. When not in use, the connecting conduit 130 is stored in a mount 132 provided on the tank 110 adjacent to one end thereof. In order to maintain the flexible connecting conduit at the proper position, a support arm 135 therefor is provided which is mounted upon one end of the tank 110 at a pivot 136 and extends outwardly therefrom towards the adjacent tank 110 and carries on the outer end a clamp 137 engaging the associated connecting conduit 130 so as to hold the connecting conduit 130 in the proper position at all times during transport of the railway tank cars 100.

Figure 5:
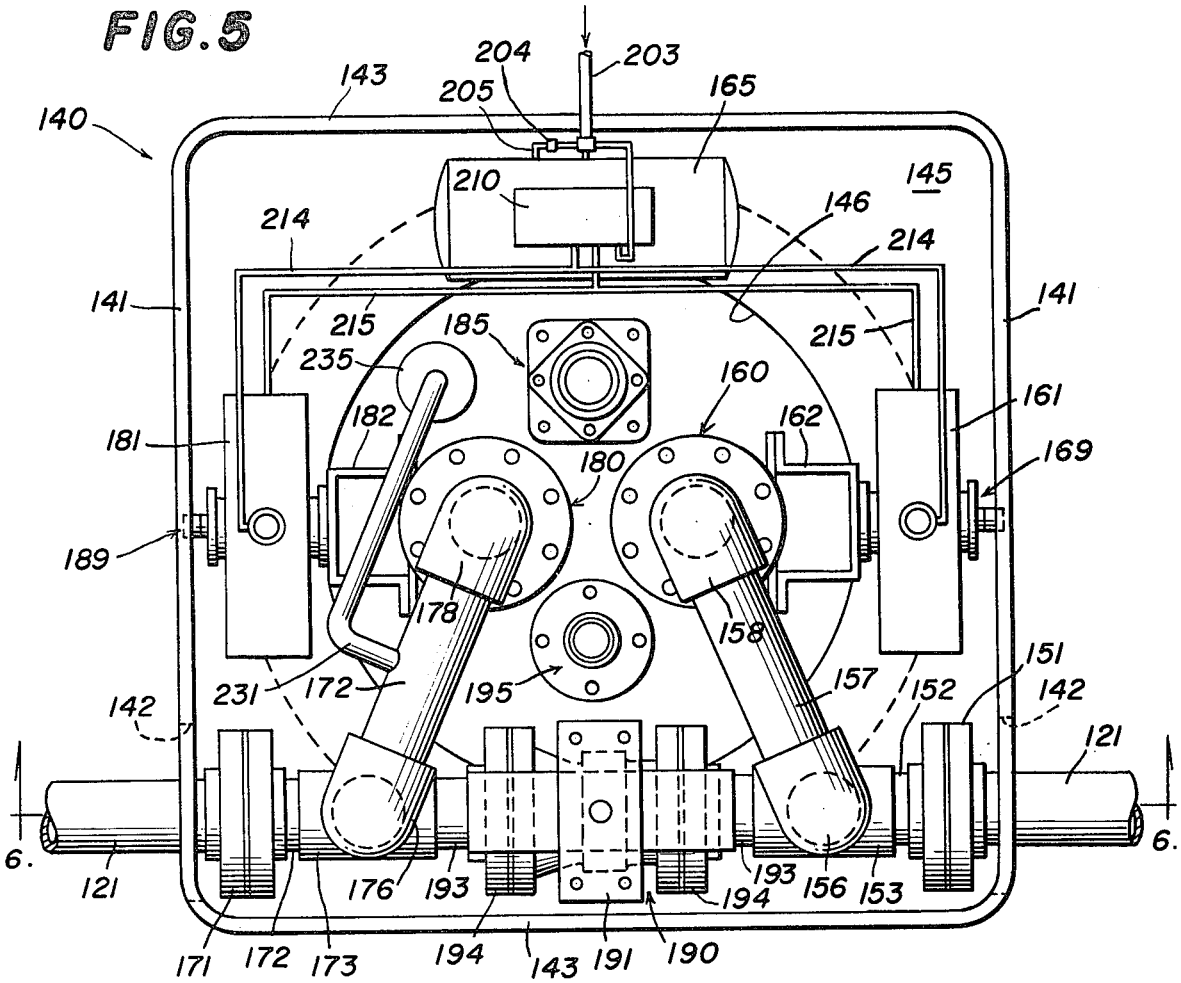
FIG. 5 is an enlarged plan view of a first embodiment of the control valves and valve control mechanism useful in the loading of fluid ladings into the tank cars and unloading of fluid ladings from the tank cars of FIG. 3.
Figure 6:
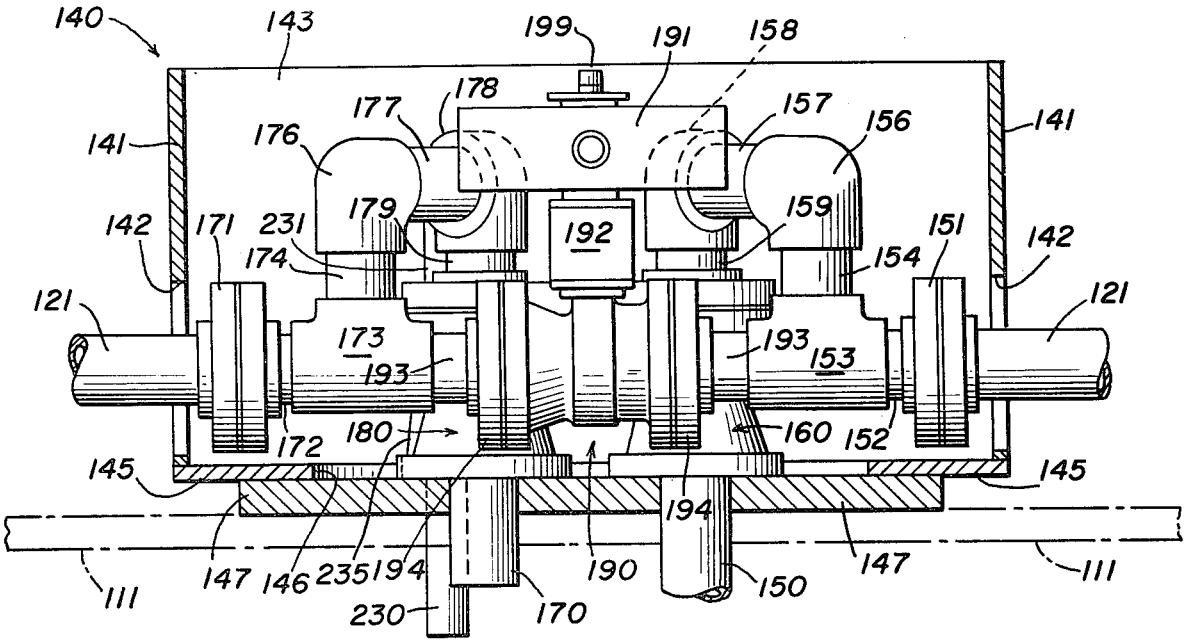
FIG. 6 is a view in vertical section along the line 6—6 of FIG. 5.

Mounted centrally of each of the tanks 110 and on top thereof is a protective housing 140 into which extends the offset section 121 of the lading conduit 120 and within which are housed a first preferred embodiment of the control valves and valve control mechanism of the present invention. Referring particularly to FIGS. 5 and 6 of the drawings, it will be seen that the protective housing 140 includes a pair of opposed end walls 141 having openings 142 therein receiving the offset section 121 of the lading conduit 120. Opposed side walls 143 are provided integrally joined at the ends with the end walls 141 and in turn all of the walls 141 and 143 are joined to a bottom wall 145, such as by welding. The bottom wall 145 has an opening 146 centrally therein and is secured for mounting purposes upon a mounting plate 147 that is securely fastened to the shell 111 of the tank 110.

Figures 7, 8, 9, 10:
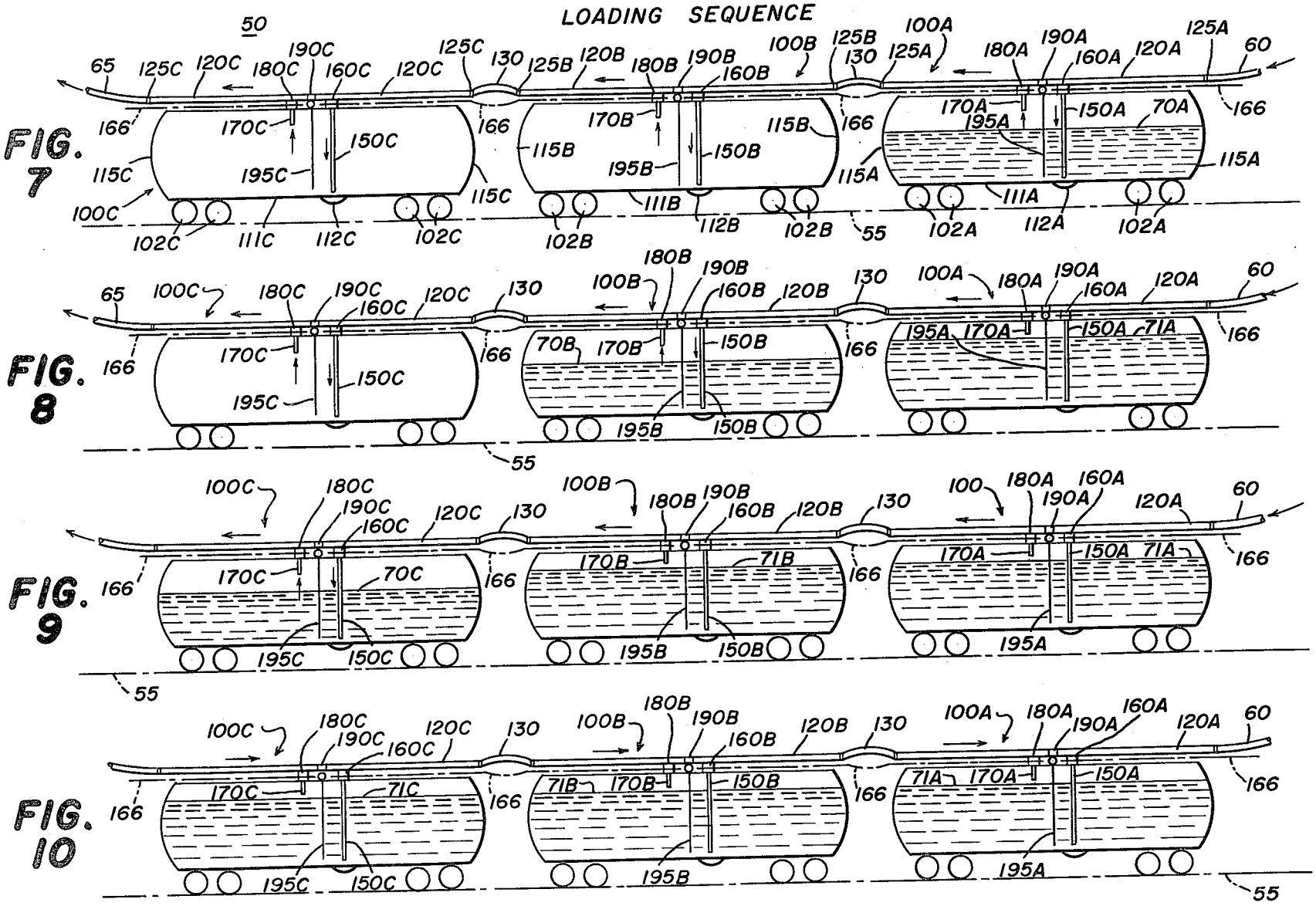
FIG. 7 through FIG. 10 diagrammatically illustrate the loading sequence for a train of three railway tank cars made in accordance with and embodying the principles of the present invention.
Figures 11, 12, 13, 14:
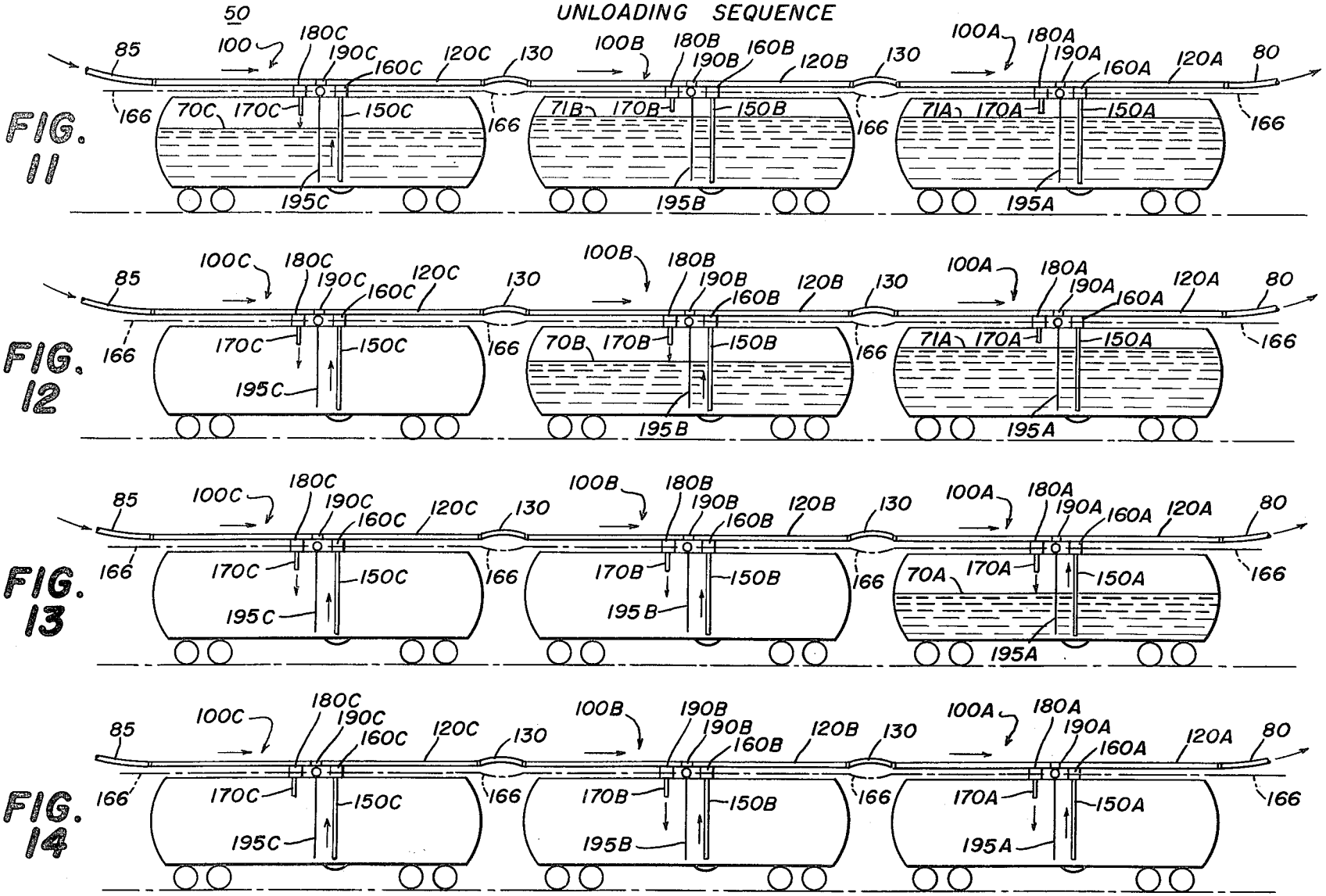
FIG. 11 through FIG. 14 diagrammatically illustrate the unloading sequence for a string of three railway cars made in accordance with and embodying the principles of the present invention.

The righthand conduit section 121 as viewed in FIGS. 5 and 6 is connected to a first pipe 150 that extends vertically through the mounting plate 147 and the shell 111 and into the interior of the tank 110 and terminates essentially in the associated sump 112 (see FIG. 7). More specifically, the conduit section 121 is connected by a coupling 151 to a pipe section 152 that in turn is connected to a tee 153. The leg of the tee 153 carries a pipe section 154 that connects with an elbow 156 that in turn connects with a pipe section 157 and a second elbow 158 to a pipe section 159. Disposed between the pipe section 159 and the first pipe 150 is a control valve generally designated by the numeral 160. The control valve 160 is provided with an actuator 161 which is pneumatically driven, and is connected by a coupler 162 to the control valve 160 so as to control the position thereof. The position of the control valve 160 is visually indicated by a valve position indicator 169 mounted on and driven by the actuator 161. Control gas supply for the actuator 161 is in part derived from an accumulator tank 165 on which is disposed a spool or pilot valve 210. Gas for the accumulator tank 165 is received from a main gas line 166 through a gas line 203, a check valve 204 and a gas line 205. The output from the spool valve 210 appears on a first control gas line 214 and a second control gas line 215, both of which are connected to the control valve actuator 161. The term "gas" as used herein includes any suitable control gas such as nitrogen as well as air, and in fact the preferred gas is nitrogen as will be explained more fully hereinafter.

A second pipe 170 extends vertically through the mounting plate 147 and the shell 111 of the tank 110 and into the body thereof and terminates in an open end a short distance below the top of the tank shell 111, see FIG. 5 particularly. A coupling 171 connects the left-hand conduit section 121 in FIGS. 5 and 6 to a pipe section 172 that is in turn connected to one arm of a tee 173, the leg of the tee 173 being connected by a pipe section 174 to an elbow 176 which in turn carries a pipe section 177 connected by an elbow 178 to a pipe section 179. A control valve 180 interconnects and is interposed between the pipe section 179 and the second pipe 170. Referring to FIG. 5, it will be seen that an actuator 181 is provided for the control valve 180, the actuator 181 being of the pneumatic type. A coupler 182 connects the actuator 181 to the control valve 180, the position of the control valve 180 being visually indicated by a valve position indicator 189 mounted on and driven by the actuator 181. The control gas lines 214 and 215 both also connect with the actuator 181, whereby the actuators 161 and 181 are actuated in synchronism under the control of the spool valve 210, this serving to control the positions of the control valves 160 and 180 substantially at the same time. A vent line 230 extends vertically through the mounting plate 147 and into the tank 110 and terminates in an open lower end a short distance below the lower end of the pipe 170. The upper end of the vent line connects to a manually operable valve 235 that is connected by a bypass line 231 to the pipe section 172 for a purpose to be described later.

Figure 17:
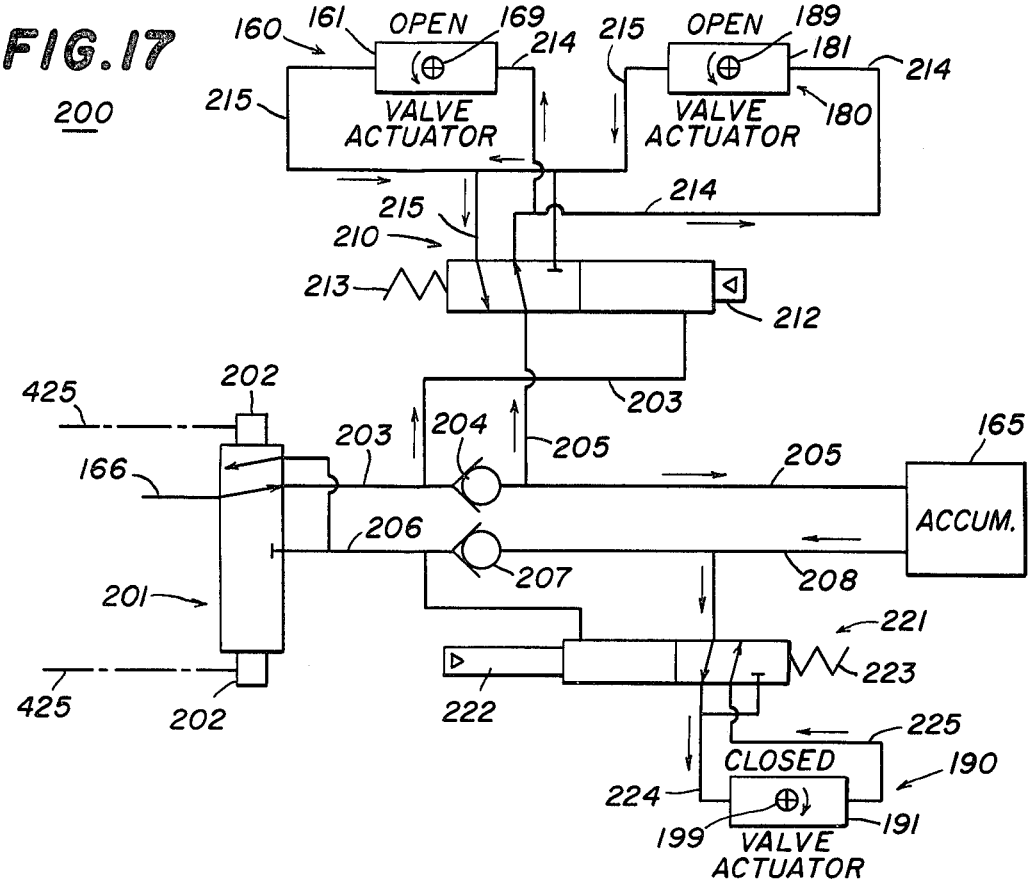
FIG. 17 is an electrical and pneumatic schematic diagram of the control valves and valve control mechanism illustrated in FIGS. 5 and 6 of the drawings and showing the parts in the loading positions thereof.
Figure 18:
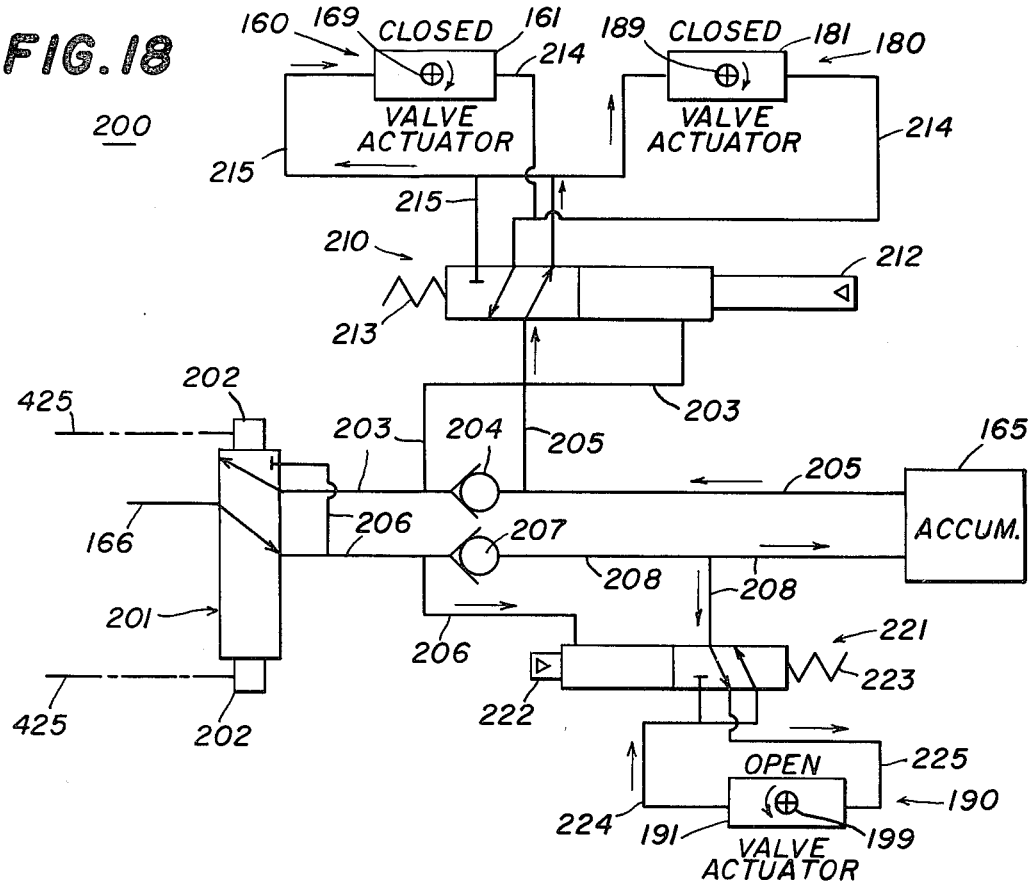
FIG. 18 is an electrical and pneumatic schematic diagram similar to FIG. 17 and showing the parts thereof in the unloading positions thereof.

A control valve 190 is interposed in the lading conduit section 121 between the first pipe 150 and the second pipe 170, the control valve 190 being provided with an actuator 191 which is pneumatically operated and is connected by gas lines (not shown) to a spool or pilot valve 221 (see FIGS. 17 and 18). The actuator 191 is connected by a coupler 192 to the control valve 190, and the position of the control valve 190 is visually indicated by a valve position indicator 199. The control valve 190 is connected by pipe sections 193 and couplings 194 to the other arm of the tees 153 and 173. There also is provided in FIG. 5 a safety valve 185 which provides an outlet for gases within the tank 110 if the pressure therein rises above the predetermined level set by the safety valve 185. There further is provided a liquid level sensor 195 which senses the unloaded condition of the tank 110, i.e., the lowering of the fluid level within the tank 110 to or below the lower open end of the first pipe 150. The liquid level sensor 195 also senses either of two loaded conditions of the tank 110, the first being a lower or "summer" level loaded condition and the second being a higher or "winter" level loaded condition, the level of both loaded conditions being below the lower end of the second pipe 170 with the "winter" level loaded condition setting being immediately below the lower end of the second pipe 170, and the "summer" level loaded condition setting being immediately below the lower end of the vent line 230, thus to control the outage or free vapor space in the filled tank car.

Referring to FIGS. 17 and 18, there is illustrated the electrical-pneumatic control system 200 for controlling the positions of the control valves 160, 180 and 190, and specifically the associated valve actuators 161, 181 and 191 therefor, respectively. A solenoid control valve 201 is provided including an operating solenoid 202 having input conductors 425, one of the input ports of the solenoid control valve 201 being connected to the main gas line 166, while one of the outlet ports is connected to a gas line 203 and the other two outlet ports are connected to a gas line 206. The gas line 203 is connected as one of the inputs to a spool valve 210 that controls the valve actuators 161 and 181. The spool valve 210 includes the usual spool 212 and a return spring 213. One of the outlet ports of the spool valve 210 is connected to the gas line 214, while the other two outlet ports are connected to the gas line 215. As has been explained heretofore, the gas line 214 is also connected as one of the inputs to the valve actuators 161 and 181 while the gas line 215 is connected to one of the inlets to the valve actuators 161 and 181.

The accumulator 165 is also charged with gas under pressure from the main gas line 166 through the solenoid control valve 201 and the gas line 203. More specifically, the gas line 203 is connected to a check valve 204 with the outlet of the check valve 204 being connected by a gas line 205 to the first connection to the accumulator 165. A second connection to the accumulator 165 is made by a gas line 208 which is connected to the gas line 206 through the check valve 207. The valve actuator 191 is controlled by a spool valve 221 having a spool 222 returned by a spring 223. A connection is made from the gas line 206 to the spool valve 221 and one of the input ports to the spool valve is connected to the gas line 208. One of the outlet ports of the spool valve 221 is connected by a line 225 to the valve actuator 191 while the other two outlet ports of the spool valve 221 are connected by a gas line 224 to the other connection to the valve actuator 191.

When an unloaded tank car 100 is to be loaded with liquified compressed gases, the control valves 160, 180 and 190 are initially closed and there is no connection to the main gas line 166 and there is no electrical connection to the conductors 425 connected to the solenoid control valve 201. The first step in the loading operation is to connect a supply of gas under pressure, preferably an inert gas such as nitrogen, to the main gas line 166. The conductors 425 are connected to a terminal control system (to be described more fully hereinafter). The solenoid control valve 201 is initially in the position illustrated in FIG. 17, and accordingly upon connection of the gas supply to the main gas line 166 (at 90 p.s.i.g. or higher pressure), the line 166 is connected through the solenoid control valve 201 to the line 203. The accumulator 165 is charged through the check valve 204 and the line 205 to essentially the pressure in the line 166. The pressure in the line 166 is also conveyed through the line 203 to move the spool valve 210 from the spring held position of FIG. 18 to the position illustrated in FIG. 17. The pressure from the line 205 is then applied through the spool valve 210 to the line 214, this moving the valve actuators 161 and 181 to the open positions thereof, thus opening the associated valves 160 and 180, respectively, and thus opening the associated pipes 150 and 170. It is noted that the line 215 is vented at the spool valve 210 which is held in the position illustrated in FIG. 17 against its spring 213 by the pressure in line 203. The spool valve 221 is held in the position illustrated in FIG. 17 by its spring 223, it being noted that the spool valve 221 is not pressurized. In fact, pressure is supplied from the line 208 through the spool valve 221 to the line 224 that holds the valve actuator 191 in the closed position thereof and thus to hold the valve 190 closed and thus closing the lading conduit 120 between the pipes 150 and 170.

Upon the associated fluid level sensor 195 detecting the loaded condition of the tank car 100, a signal is sent thereby to a terminal control system and the return signal is received on the conductors 425 to shift the solenoid control valve 201 in the tank car 100 from the position illustrated in FIG. 17 to the position illustrated in FIG. 18 (all as to be described more fully hereinafter). The main gas line 166 is now connected through the solenoid control valve 201 to the line 206 and the line 203 is open to vent and has no pressure applied thereto from the main line 166. Since there is no pressure applied to the line 203, the spring 213 in the spool valve 210 returns the spool 212 to the right as viewed in FIG. 18 and this connects the line 205 through the spool valve 210 to the line 215 to move the valve actuators 161 and 181 to close the associated valves 160 and 180, and thus to close the associated pipes 150 and 170. It is noted that the line 214 is open to exhaust to enable the closing of the valves 160 and 180. The pressure in the line 208 charges the accumulator 165 to essentially the same pressure as in the main gas line 166. Since the spool 212 of the valve 210 is held in the position illustrated in FIG. 18 by the spring 213, gas in the accumulator 165 through line 205 enters the line 215. Pressure in the line 206 also moves the spool 222 of the spool valve 221 to the position illustrated in FIG. 18 and thus connects the line 208 through the spool valve 221 to the line 225 which moves the valve actuator 191 to the open position thereof, thus opening the associated valve 190 and the lading conduit 120 between the associated pipes 150 and 170. If the pressure in the line 166 is lost or relieved, the line 206 will be depressurized and the spool 222 of the valve 221 will be moved by its spring 223 to the position illustrated in FIG. 17. Thereupon gas from the accumulator through line 208 enters line 224 to move the valve actuator 191 and the associated valve 190 to the closed positions thereof, it being noted that the pressure in the line 225 will have been relieved.

There is illustrated in FIG. 1 of the drawings the loading system 400 for loading liquified compressed gas into a train 50 of the tank cars 100. A supply 401 of liquified compressed gases is provided having an outlet pipe 402 with a control valve 403 therein and connected to a pump 405 and particularly the suction inlet thereof by a pipe 406, the discharge outlet of the pump 405 being connected by a pipe 407 to a valve 408 connected to the loading conduit 60 that in use is connected to the adjacent end of the lading conduit 120 on the adjacent car 100. A supply 410 of compressed gas is also provided, the preferred gas being nitrogen, under a pressure of at least 90 p.s.i.g. Other gases, including air, can be used, but inert gases such as nitrogen are preferred to reduce the explosion hazards during the loading operation. The nitrogen supply 410 has its outlet connected to an outlet pipe 411 in which is disposed a first valve 412 that connects to the loading conduit 60, and a second control valve 413 that connects to the adjacent end of the main gas line 165 on the adjacent tank car 100. There further is provided a vapor recovery system 415 having the inlet thereof connected to the conduit 65 connecting with the last tank car 100C in the train 50, and connecting specifically to the adjacent end of the lading conduit 120, the outlet of the vapor recovery system 415 being connected by a pipe 416 to the inlet of the supply 401. Finally, there is provided a terminal control system 420 having an electrical power supply generally designated by the numeral 421 provided on conductors 422 and 423. One output from the terminal control system 420 is the conductor 425 that connects to each of the solenoid control valves 201 described hereinabove. There also is provided a conductor 426 connected to each of the fluid or liquid level sensors 190.

Referring to FIGS. 1, 7–10, 17 and 18, a typical loading cycle using the loading system 400 will be described in detail. There has been provided a railway siding 55 adjacent to the supply 401 of liquified compressed gas, and disposed upon the railway siding 55 is a string of tank cars 100, three having been shown for purposes of illustration only. It is intended that strings of tank cars 100, for example, ten cars in length will be provided, and it is further contemplated that several of the groups of ten tank cars may be connected in a single train to provide a unit train of tank cars. In order to distinguish among the cars in the train 50 in FIGS. 1 and 7–10, the reference numerals applied to the railway tank cars 100 of FIGS. 2–6 have had suffixes "A", "B" and "C" applied from right to left in FIGS. 1 and 7–10. The tank cars 100A to 100C arrive in position on the rails 55 in an unloaded condition and the free end of the lading conduit 120A disposed to the right has a cap thereon closing that the end of the lading conduit 120A and the lefthand end of the lading conduit 120C also has a cap thereon. The cap on the righthand end of the lading conduit 120A is removed and the loading conduit 60 is coupled thereto, and the cap on the lefthand end of the lading conduit 120C is removed and a vapor line or conduit 65 is attached thereto. It will be appreciated that although the tank cars 100A to 100C are unloaded, there still remains therein a quantity of liquified compressed gas, or at least the vapors thereof, which may typically have a pressure on the order of 100 p.s.i.g., whereby upon opening of the valves associated therewith, an immediate pressure on the order of 100 p.s.i.g. is provided at the ends of the conduits 60 and 65. The conduit 60 is connected to the outlet of the valve 408 for the pump 405 while the conduit 65 is connected to the input to the vapor recovery system 415. Accordingly, the entire system will immediately be under pressure on the order of 100 p.s.i.g. and there will be a minimal introduction of air or oxygen into the system, thus minimizing the likelihood of a fire or explosion. The nitrogen supply 410 is connected through the valve 413 to the main gas line 166 and pressure is applied thereto on the order of 90 p.s.i.g. Finally, the conductor 425 is connected to the solenoid control valves 201 and the conductor 426 from the terminal control system 420 is connected to the liquid level sensors 195.

When the tank cars 100A to 100C arrive for the loading operation, all of the control valves 160, 180 and 190 are closed. Furthermore, the solenoid control valves 201 and the spool valves 221 are in the positions illustrated in FIG. 17 of the drawings, while the spool valve 210 is in the position illustrated in FIG. 18. When the nitrogen supply 410 is connected to the main gas line 166 and the valve 413 opened, the high pressure gas will be directed by the solenoid control valves 201 to the lines 203 which will immediately begin charging the accumulators 165 and will move the spools 212 against the springs 213 in the spool valves 210 so as to connect the lines 205 to the lines 214. This will cause the valve actuators 161 and 181 to move so as to open the associated control valves 160 and 180 on all of the cars in the train 50, the lines 215 being vented to the atmosphere through the spool valves 210. It is noted that the control valves 190 will remain closed since no pressure will be applied along the line 206 to the spool valve 221 and pressure will be applied from the accumulator 165 through the line 208, the spool valve 221 and the line 224 to hold the actuators 191 and the associated valves 190 in the closed positions thereof.

Fluid lading, such as liquified petroleum gas, is now pumped from the supply 401 through the outlet pipe 402, the open valve 403, the pipe 406 via the pump 405 and then through the pipe 407 and the open valve 408 to the loading conduit 60 and then into the lading conduit 120A. The fluid lading flows through the open valve 160A and down through the first pipe 150A and into the interior of the tank car 100A. The valve 190A is closed while the valve 180A is open, whereby the fluid lading flows only through the first pipe 150A. Referring to FIG. 7, the tank car 100A is shown partially filled as at a fluid level 70A therein. The vapors generated during the loading operation of the tank car 100A pass upwardly through the second pipe 170A, and specifically through a vapor nozzle at the open end thereof and into that portion of the lading conduit 120A disposed to the left of the control valve 190A and into the next tank car 100B, for venting and pressure equalization of vapors that might be therein. Since the valves 160 and 180 in the tank cars to the left of the tank car 100A are all open and the valves 190 on the tank cars to the left of the tank car 100A are all closed, the vapors will pass from car to car and will exit through the vapor conduit 65 and thus to the input to the vapor recovery system. The recovered liquified compressed gas from the vapor recovery system 415 are conveyed by the pipe 416 to the input of the supply 401 of liquified compressed gas.

When the fluid level in the tank 110A reaches a predetermined point illustrated by the numeral 71A in FIG. 8, the liquid level sensor 195A is activated and generates a control signal that is conveyed by the conductor 426 to the terminal control system 420. The terminal control system 420 in turn creates a control signal that is conveyed by the conductors 425 and is applied to the solenoid control valve 201 on the car 100A to move the parts thereof to the positions illustrated in FIG. 18. The main gas line 166 is now connected to the line 206 and through the check valve 207 to the line 208 whereby further to charge the accumulator 165 and to move the spool 222 on the spool valve 221 to the position illustrated in FIG. 18. Gas pressure is now applied through the spool valve 221 from the line 208 to the line 225 which moves the valve actuator 191 to a position to open the associated control valve 190 and thus to open the lading conduit 120A. In the meantime, pressure has been relieved from the spool valve 210 and therefore the spring 213 moves the spool 212 to the position illustrated in FIG. 18 which relieves the pressure from the line 214. Thereupon gas from the accumulator through line 205 enters line 215 and serves to move the valve actuators 161 and 181 to positions to close the associated valves 160A and 180A, respectively, and thus to close the pipes 150A and 170A. The tank car 100A is now loaded and the loading position shifts to the car 100B since the valves 160B and 180B are open therein while the valve 190B is closed.

The liquified compressed gas now flows from the supply 401 under the urging of the pump 405 and through the opened valves 403 and 408 into the loading conduit 60 and through the lading conduit 120A and connecting conduit 130 and into the righthand portion of the lading conduit 120B. Since the valve 190B is closed, the lading is diverted and flows through the pipe 150B. The tank car 100B is then loaded in the same manner as was tank car 100A described above. When the tank car 100B is fully loaded, the liquid level sensor 195B senses the fully loaded condition and sends a signal by the conductor 426 to the terminal control system 420 which in turn generates a control signal that is conveyed along the conductors 425 to the solenoid control valve 201 associated with the tank car 100B. Actuation of the solenoid control valve 201 on the tank car 100B serves to open the control valve 190B to open the lading conduit 120B and to close the control valve 160B and 180B and to close the associated pipes 150B and 170B as correspondingly previously described in connection with tank car 100A.

With the control valves 190A and 190B open and the control valves 160A and 180A closed and the control valves 160B and 180B closed, a passage is now completed from the pump 405 through the valve 408 and the loading conduit 60 through the lading conduits 120A and 120B and the associated connecting conduits 130 to the righthand end of the lading conduit 120C. The control valves 160C and 180C are open while the control valve 190C is closed. Accordingly, the fluid lading is loaded into the tank car 100C through the first pipe 150C. Loading of the tank car 100C proceeds as described above with respect to the loading of the tank cars 100A and 100B until the liquid level sensor 195C senses the loaded condition of the tank car 100C as illustrated in FIG. 10. At this time, the liquid level sensor 195C will produce a signal conveyed by the conductor 426 to the terminal control system 420 which in turn will generate a control signal conveyed by the conductors 425 to the solenoid control valve 201 on the tank car 100C. This will shift the solenoid control valve 201 on the tank car 100C from the position illustrated in FIG. 17 to that illustrated in FIG. 18 This will serve to open the control valve 190C and to close the control valves 160C and 180C. The string of cars at the loading system 400 is now completely loaded.

It will be understood that during the entire sequence of loading of the tank cars 100A, 100B and 100C, the vapors generated are passed from car to car and outwardly eventually through the vapor conduit 65 to the inlet to the vapor recovery system 415, and the recovered vapors are then conveyed by the pipe 416 to the inlet of the supply 401 of liquified compressed gases. With the loading of the various tank cars now essentially completed as illustrated in FIG. 10, the lading conduits 120A, 120B and 120C are then purged of liquid and commodity vapor. This is accomplished by closing the valve 408 and opening the valve 412, thus to supply nitrogen gas from the supply 410 thereof through the outlet pipe 411, the now open valve 412 and the loading conduit 60 and through the lading conduits 120A, 120B and 120C outwardly through the conduit 65 to the inlet to the vapor recovery system 415. It will be understood that all of the valves 160 and 180 are closed at this time and all of the valves 190 are open, the solenoid control valves 201 being in the positions illustrated in FIG. 18. After the purging, the valve 412 is closed and the loading conduit 60 is disconnected from the righthand end of the lading conduit 120A and a cap is placed thereon. Likewise, the conduit 65 is removed from the lefthand end of the lading conduit 120C and a cap placed on the free end of the lading conduit 120C. The connection between the valve 413 and the main gas line 166 is removed and the conductors 425 and 426 are disconnected from the adjacent car 100A. Disconnection of the gas supply from the main gas line 166 removes the pressure from the line 206 (see FIG. 18) and thereby removes the pressure from the spool valve 221 permitting the spring 223 thereof to move the parts to the position illustrated in FIG. 17. As a consequence, the line 208 is connected through the spool valve 221 to the line 224 and the pressure within the accumulator 165 serves to move the valve actuator 191 to close the associated valve 190. In this manner, all of the valves 190A, 190B and 190C in the train 50 are moved to the closed positions thereof. Summarizing, all of the valves 160, 180 and 190 along the entire length of the train 50 are now in the closed positions. These valves all remain in the closed positions during the transport of the train 50 to the point of unloading.

There is illustrated in FIG. 2 of the drawings the unloading system 500 for unloading liquified compressed gas from a train 50 of the tank cars 100. A container 501 for liquified compressed gas is provided having an inlet connection 502 with a control valve 505 therein connecting to an unloading conduit 80 that in use is connected to the adjacent end of the lading conduit 120 on the adjacent car 100. A supply 510 of compressed gas is also provided, the preferred gas being nitrogen, under a pressure of at least 90 p.s.i.g. The nitrogen supply 510 has an outlet connection 511 in which is disposed a valve 513 that connects to the adjacent end of the main gas line 166. Compressed gas vapors from the container 501 of liquified compressed gas are used as the motive power for unloading the tank cars 100A, 100B and 100C. To that end there has been provided a compressor 515 having its suction side connected by a line 516 through a valve 518 to the container 501 to withdraw vapors therefrom, and having its discharge side connected to a discharge line 517 that is connected through a valve 519 to the conduit 85. Finally, there is provided a terminal control system 520 having an electrical power supply generally designated by the numeral 521 provided on two conductors 522 and 523. One output from the terminal control system 520 is the conductor 525 that connects to each of the solenoid control valves 201 described hereinabove. There also is provided a conductor 526 connected to each of the fluid or liquid level sensors 190.

Referring to FIGS. 2, 11–14, 17 and 18, a typical unloading cycle using the unloading system 500 will be described in detail. There has been provided a railway siding including tracks 55 adjacent to the container 501 for liquified compressed gases, and the train to be unloaded is positioned thereon.

The solenoid control valves 201 are in the positions illustrated in FIG. 18, and since no pressure is applied to the line 166, all of the valves 160, 180 and 190 are closed and are further urged into the closed positions by the air pressure provided from the accumulator 165 through the line 215 for the control valves 160 and 180 and through the line 224 for the control valve 190. The unloading conduit 80 is connected to the righthand end of the lading conduit 120A and is connected through the valve 505 and the line 502 to the inlet for the container 501 for liquified compressed gas. The conductor 525 from the terminal control system 520 is connected to the conductors for the solenoid control valves 201, and the conductor 526 is connected to the liquid level sensors 195. The supply 510 of nitrogen under pressure is connected by the pipe 511 through the valve 513 to the main gas line 166. Finally, the valve 519 is connected to the unloading conduit 85 attached to the lefthand end of the lading conduit 120C. Upon opening of the valve 513, pressure will be applied to the line 166 and as is best illustrated in FIG. 18 of the drawings, pressure is then applied through the solenoid control valves 201 to the lines 206 which actuate the spool valves 221 to the position illustrated in FIG. 18 and also supplies pressure to the line 208 so as to deliver pressure through the spool valves 221 to the lines 225 that moves the valve actuators 191 to open the associated control valves 190, thus to open the associated lading conduits 120, the lines being vented to atmosphere through the spool valves 221. In other words, application of pressure to the line 166 serves to open all of the control valves 190A, 190B and 190C, thus to provide a single open conduit from the unloading conduit 80. The pressurized lines 208 also charge the accumulator 165 and the lines 205 which through the spool valves 210 pressurizes the lines 215 to hold the valve actuators 161 and 181 and the associated valves 160 and 180 closed. Opening of the valves 518 and 519 now applies the commodity gas vapors under pressure from the compressor 515 to the lefthand end of the lading conduit 120C. At this time the operator causes a control signal to be generated at the terminal control system 520 and conveyed along the conductor 525 to the solenoid control valve 201 on the tank car 100C. This control signal shifts the solenoid control valve 201 on tank car 100C from the position illustrated in FIG. 18 to that illustrated in FIG. 17. As a consequence, the control valves 160C and 180C are opened, thus to open the associated pipes 150C and 170C, while the control valve 190C is closed, thus to close the lading conduit 120C between the pipes 150C and 170C. The fluid lading is then forced by the pressure of the gases from the compressor 515 out of the tank 110C up through the pipe 150C and into the righthand portion of the lading conduit 120C and then through the interconnected lading conduits 120B and 120A and the associated connecting conduits 130 to the right and to the unloading conduit 80. This action will continue until the tank car 100C is unloaded, it being noted that the lading therefrom flows directly into the container 501 without entering any of the other tank cars in the train 50.

When the tank car 100C is unloaded, the liquid level sensor 195C is activated and generates a control signal that is conveyed by the conductor 526 to the terminal control system 520. The terminal control system 520 in turn creates a control signal that is conveyed by the conductor 525 and is applied to the solenoid control valve 201 on the tank car 100B which shifts the solenoid control valve 201 on the tank car 100B from the position illustrated in FIG. 18 to that illustrated in FIG. 17. As a consequence, the control valves 160B and 180B are opened, thus to open the associated pipes 150B and 170B, while the control valve 190B is closed, thus to close the lading conduit 120B between the pipes 150B and 170B. The fluid lading is then forced by the pressure of the compressed gases from the compressor 515 out of the tank 100B up the pipe 150B and into the righthand portion of the lading conduit 120B and then through the interconnected lading conduit 120A and the associated connecting conduit 130 to the right and to the unloading conduit 80. This action will continue until the tank car 100B is unloaded, it being noted that the lading therefrom flows directly into the container 501 without entering any of the other tank cars in the train 50.

When the tank car 100B is unloaded, the liquid level sensor 195B is activated and generates a control signal that is conveyed by the conductor 526 to the terminal control system 520. The terminal control system 520 in turn creates a control signal that is conveyed by the conductors 525 and applied to the solenoid control valve 201 on the car 100A to move the parts thereof from the positions illustrated in FIG. 18 to the positions illustrated in FIG. 17. As a consequence, the control valves 160A and 180A are opened, thus to open the associated pipes 150A and 170A, while the control valve 190A is closed, thus to close the lading conduit 120A between the pipes 150A and 170A. The fluid lading is then forced by the pressure of the compressed gases from the compressor 515 out of the tank 110A up through the pipe 150A and into the righthand portion of the lading conduit 120A and then to the unloading conduit 80. This action will continue until the tank car 100A is unloaded, it being noted that the lading therefrom flows directly into the container 501 without entering any of the other tank cars from the train 50.

With all of the tank cars 100A, 100B and 100C now unloaded, it will be noted that the valves 190A, 190B and 190C are all closed while the valves 160A, 160B, 160C, 180A, 180B, and 180C are all open. Disconnection of the valve 519 from the unloading conduit 85 and disconnection of the nitrogen supply 510 from the main gas line 166 leaves the control solenoids 201 in the position illustrated in FIG. 17 and removes pressure from the lines 203, whereby the spool valves 210 are returned by the springs 213 to the position illustrated in FIG. 18. The pressure in the accumulators 165 applied through the lines 205 to the lines 215 move the valve actuators 161 and 181 and the associated control valves 160 and 180 all to the closed positions. It will be seen therefore that all of the control valves 160, 180 and 190 are now in the closed positions, and these valves all remain in the closed positions during the transport of the unloaded train 50 to the point of loading.

From the above description of the loading system of FIG. 1 and the unloading system of FIG. 2, it will be seen that the train 50 can be fully loaded and fully unloaded from a single location without any movement thereof and without any movement of the tank cars 100 within the train 50 and without disconnecting any of the tank cars 100 one from another. The loading of the tank cars 100 is accomplished singly and in sequence from right to left as viewed in FIGS. 1 and 7–10, the interconnected lading conduits 120 with the associated connecting conduits 130 forming a common header or manifold. Only a single tank car 100 will be in liquid communication with the lading conduit 120 at any one time, and when unloading only a single tank car 100 will be in liquid communication with the lading conduit 120 at any one time. The gas or vapors are pushed through the tank cars serially during both loading and unloading, yet the liquid is loaded into the tank cars singly and sequentially and essentially in parallel, while in unloading the tank cars 100 are also unloaded singly and sequentially. Only one tank car 100 has the tank 110 thereof holding the liquid commodity exposed to the lading conduit 120 at one time during both loading and unloading.

Since the liquid lading is loaded singly and sequentially into the cars and is unloaded singly and sequentially therefrom, the system of the present invention does not have the cumulative pressure drops associated with prior systems wherein the liquid lading is loaded in series and is unloaded in series through the several tank cars.

The accumulators 165 provide a fail-safe reservoir in the event of the breaking of any of the main supply lines such as 166, or the lines 203 and 206. The accumulator serves to close the valves 190 upon the completion of the loading of the tank cars 100 and to close the control valves 160 and 180 upon the completion of the unloading of the tank cars 100.

An additional safety feature results from the utilization of a system wherein the failure of the electronic components in a single tank car 100 will not disrupt the entire loading procedure, but will enable continued loading of the tank cars. More specifically, upon the failure of an electronic component on the tank car 100B, for example, so that the tank car 100B is not in readiness for loading, or in the event of failure of any of the valving in the tank car 100B which would prevent loading thereof, the lading conduit 120B across the tank car 100B is still open and loading can proceed with the tank car 100C or any subsequent tank car which is in condition for loading. Each of the control valves 160, 180 and 190 on the tank cars 100 includes a position indicator 169, 189 and 199, respectively, so that the operator can immediately detect that one of the tank cars 100 is not operating properly and can take steps thereafter to repair or remedy the malfunction on the tank car 100B, for example, while loading proceeds with subsequent tank cars 100C, etc. As soon as the tank car 100B is repaired and placed in operative condition again, loading of the tank car 100B can proceed without interruption of the loading operation.

During the summertime the "summer" level loaded condition should be established by the proper actuation of the liquid level sensor 195A, for example, at the lower end of the vent line 230 (see FIG. 6). Failure of the liquid level sensor 195A would cause the filling of the tank 100A to continue until the "winter" level loaded condition is slightly exceeded, i.e., loading to the lower end of the second pipe 170A. Loading of the next tank car 100B will proceed since the commodity lading will simply flow upwardly through the second pipe 170A and into the lading conduit 120A and then to the tank car 100B. Such a malfunction of the liquid level sensor 195A will be detected by the workmen filling the train of tank cars 100 since after filling the valve position indicators 169A and 189A on the control valves 160A and 180A, respectively, on the tank car 100A will be in the open positions thereof rather than in the closed positions thereof and the valve position indicator 199A on the control valve 190A will also indicate that that valve is in the closed condition thereof and not the open condition thereof as it should be when the tank car 100A is filled. The operator will upon detecting the failure of the liquid level sensor 195A by observing the positions of the valve position indicators 169A, 189A, and 199A manually close the valves 160A and 180 and manually open the valves 190A and 235 (see FIG. 6). The liquid level in the car 100A will be lowered by the vapor pressure in the car to the bottom of the vent line 230, the extra lading being forced by the pressure within the car 100A upwardly through the vent line 230, through the valve 235 and through the bypass line 231 to the pipe section 172 and then to the lading conduit 120. As soon as the excess commodity lading has been thus removed from the tank car 100A, the valve 235 is manually closed by the operator.

There is illustrated in FIGS. 15, 16, 19 and 20 of the drawings a second preferred embodiment of the control valves and valve control mechanisms of the present invention, all housed within a protective housing 240. Many of the parts illustrated in FIGS. 15, 16, 19 and 20 are identical in construction and operation with parts of the control valves and valve control mechanism illustrated in FIGS. 5, 6, 17 and 18 of the drawings, and accordingly, where appropriate, like reference numerals in the 200 series have been applied to parts in FIGS. 15, 16, 19 and 20 that correspond to like numbered parts in the 100 series in FIGS. 5, 6, 17 and 18.

Figure 15:
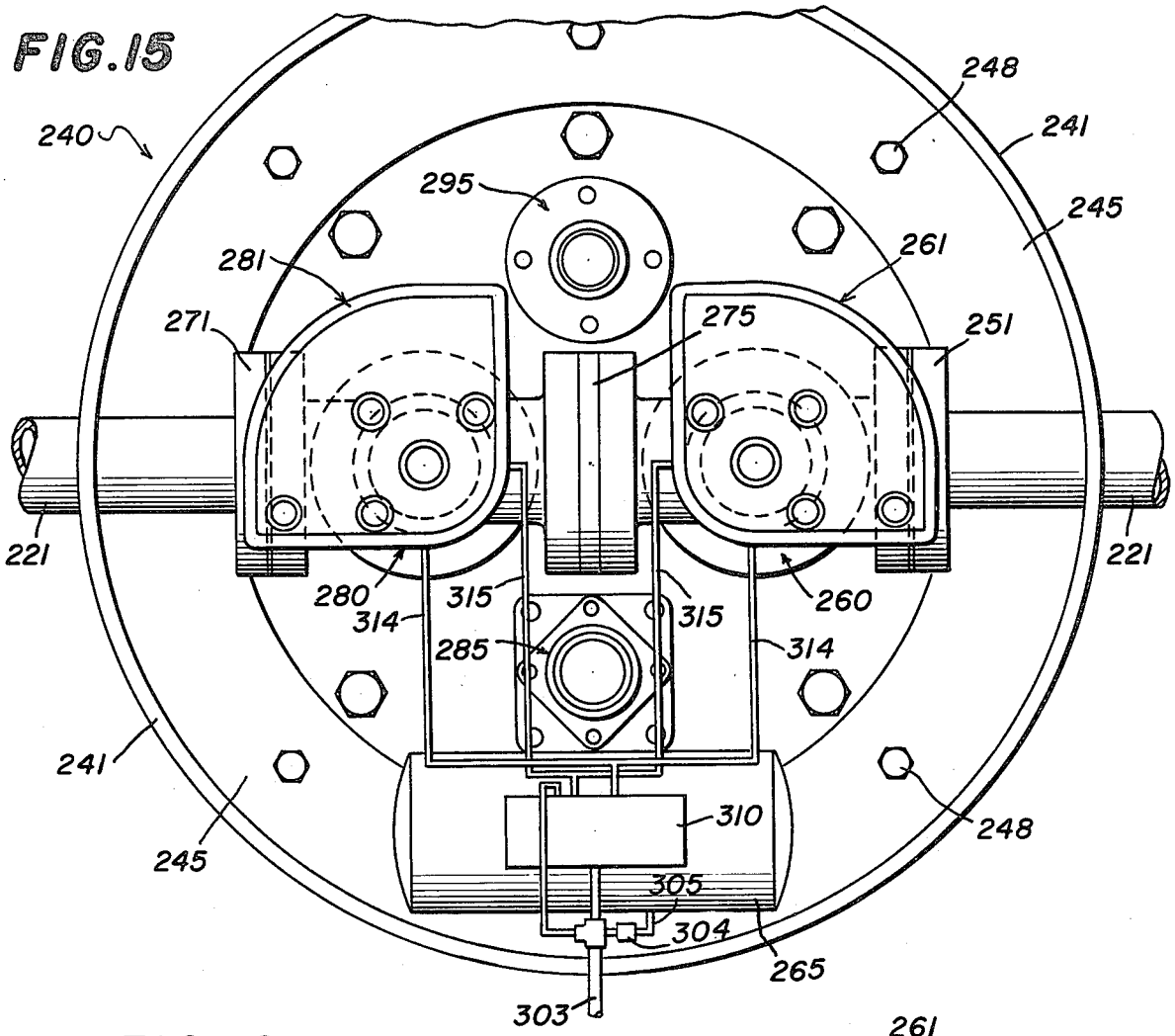
FIG. 15 is a plan view similar to FIG. 5 showing a second preferred embodiment of the control valves and valve control mechanism for a railway tank car made in accordance with and embodying the principles of the present invention.
Figure 16:
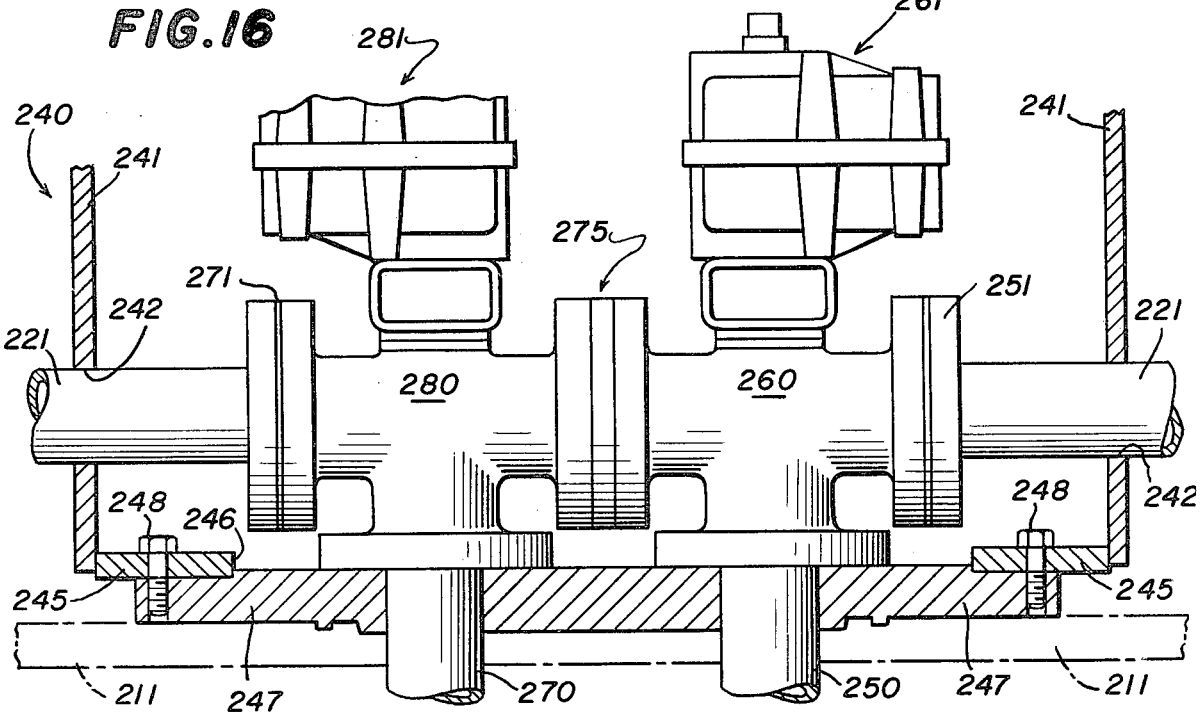
FIG. 16 is a view in vertical section through the assembly of FIG. 15.

The protective housing 240 in FIGS. 15 and 16 is cylindrical in shape and includes a cylindrical side wall 241 having openings 242 therein receiving the offset section 221 of an associated lading conduit 220. The lower portion of the side wall 241 is joined to a bottom wall 245, such as by welding, the bottom wall 245 having an opening 246 centrally therein and secured to a mounting plate 247 by a plurality of fasteners 248. The mounting plate 247 is firmly secured to the shell 211 of an associated tank car.

The righthand conduit section 221 as viewed in FIGS. 15 and 16 is connected to a coupling 251 which is in turn connected to a first control valve 260. The control valve 260 has communicating therewith a first pipe 250 that extends vertically downwardly through the mounting plate 247 and the shell 211 and into the interior of the associated tank and terminates in an associated sump (not shown) like the sump 112 described above. The control valve 260 is provided with an actuator 261 which is pneumatically driven and serves to control the valve 260 between a first or normal position wherein lading flows through the conduit section 221 from the right to the left and through the valve 260 with the pipe 250 blocked, and a second load/unload position wherein fluid lading flows from the right along the conduit section 221 and into the pipe 250, the conduit section 221 being blocked to the left of the control valve 260.

The gas supply for controlling the actuator 261 is derived from a main gas line 266 and an accumulator tank 265 on which is disposed a spool valve 310. Gas for the accumulator tank 265 is received from the main gas line 266 through a gas line 303, a check valve 304 and a gas line 305. The gas line 303 also connects the main gas line 266 to a pilot or spool valve 310 (see FIG. 19) and the gas line 305 is also connected to the spool valve 310. The output from the spool valve 310 appears on a first control gas line 314 and a second control gas line 315, both of which are connected to the control valve actuator 261.

A second pipe 270 extends vertically through the mounting plate 247 and the shell 211 of the tank and into the body thereof and terminates in an open end a short distance below the top of the associated tank. A coupling 271 connects the lefthand conduit section 221 in FIGS. 13 and 14 to one of the inputs to a second control valve 280, the second pipe 270 being also connected as an input to the valve 280, and the valves 260 and 280 being interconnected by a coupling 275. An actuator 281 is provided for the control valve 280, the actuator 281 being of the pneumatic type. The control valve 280 in the first or normal position thereof serves to provide a passage from the coupling 275 through the control valve 280 to the lefthand conduit section 221 while blocking flow to the second pipe 270. In the second or load/unload position of the valve 280, a passage is provided from the second pipe 270 through the valve 280 and to the lefthand conduit section 221, while blocking passage through the coupling 275 to the right from the control valve 280. The control gas lines 314 and 315 both also connect with the actuator 281, whereby the actuators 261 and 281 are actuated in synchronism under the control of the spool valve 310, thus serving to control the positions of the control valves 260 and 280 substantially at the same time.

There also is provided in FIG. 15 a safety valve 285 which provides an outlet for gases within the associated tank if the pressure therein rises above the predetermined level set by the safety valve 285. There also is provided a liquid level sensor 295 which senses the unloaded condition of the associated tank and either of two loaded conditions thereof, the first being a lower or "summer" level loaded condition and the second being a higher or "winter" level loaded condition, the level of both loaded conditions being below the lower open end of the second pipe 270, thus to control the outage or free vapor space in the filled tank car.

Figure 19:
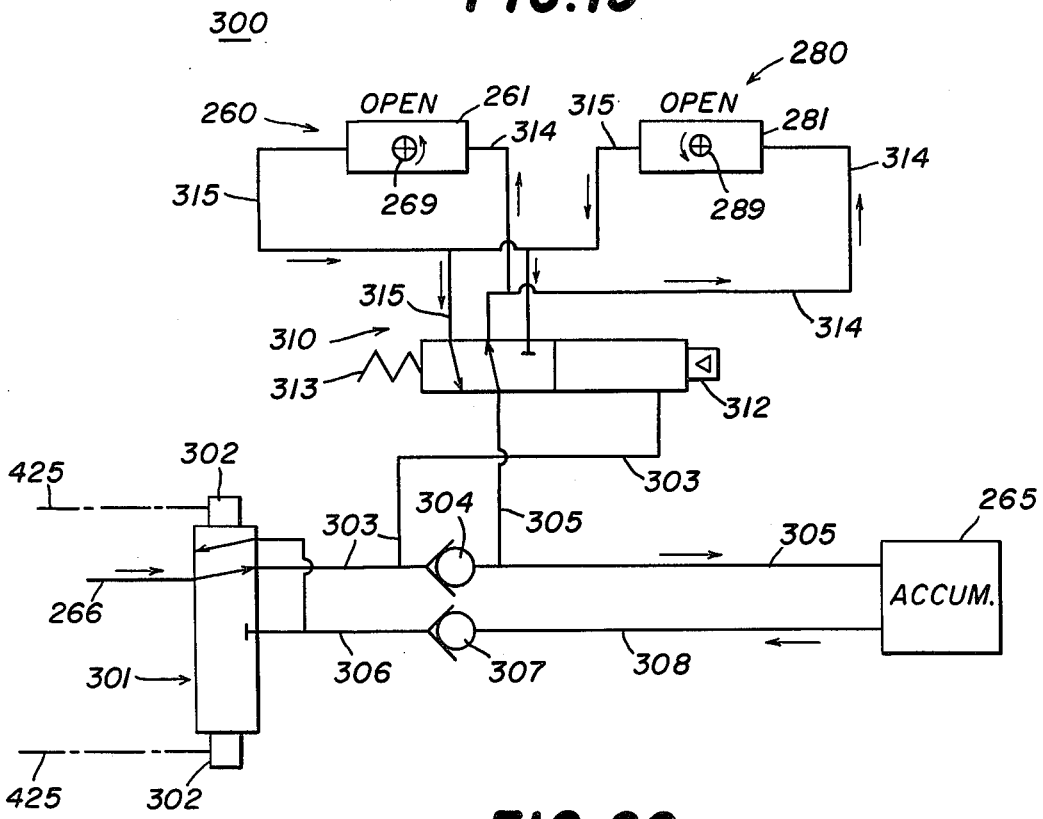
FIG. 19 is an electrical and pneumatic schematic diagram showing the interconnection between the control valves of the valve control mechanism of FIGS. 15 and 16, the parts being shown in the loading positions thereof.
Figure 20:
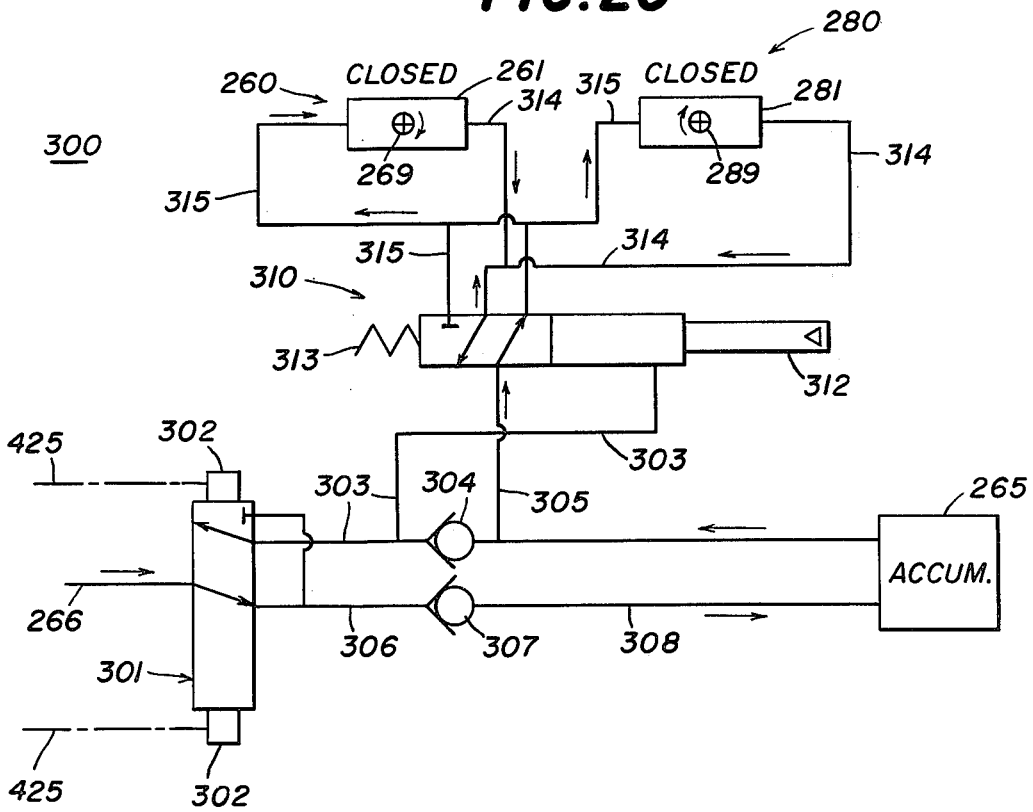
FIG. 20 is an electrical and pneumatic schematic diagram similar to FIG. 19 and showing the parts in the unloading positions thereof.

Referring to FIGS. 19 and 20, there is illustrated the electrical-pneumatic control system 300 for controlling the positions of the control valves 260 and 280, and specifically the associated valve actuators 261 and 281 therefor, respectively. A solenoid control valve 301 is provided including an operating solenoid 302 having input conductors 425, one or the input ports of the solenoid control valve 301 being connected to the main gas line 266, while one of the outlet ports is connected to a gas line 303, and the other two outlet ports are connected to a gas line 306. The gas line 303 is connected as one of the inputs to a spool valve 310 that controls the valve actuators 261 and 281. The spool valve 310 includes the usual spool 312 and a return spring 313. One of the outlet ports of the spool valve 310 is connected to the gas line 314, while the other two outlet ports are connected to the gas line 315. As has been explained heretofore, the gas line 314 is also connected as one of the inputs to the valve actuators 261 and 281 while the gas line 315 is connected to the other of the inputs to the valve actuators 261 and 281. The accumulator 265 is also charged with gas under pressure from the main gas line 266 through the solenoid control valve 301 and the gas line 303. More specifically, the gas line 303 is connected to a check valve 304 with the outlet of the check valve 304 being connected by a gas line 305 to the first connection to the accumulator 265. A second connection to the accumulator 265 is made by a gas line 308 which is connected to the gas line 306 through the check valve 307.

When an unloaded tank car is to be loaded with liquified compressed gases, the control valves 260 and 280 are initially closed and there is no connection to the main gas line 266 and there is no electrical connection to the conductors 425 connected to the solenoid control valve 301. The first step in the loading operation is to connect a supply of gas under pressure, preferably an inert gas such as nitrogen, to the main gas line 266. The conductors 425 are connected to a terminal control system such as the terminal control system 420 described above with respect to FIG. 1. The solenoid control valve 301 is initially in the position illustrated in FIG. 19, and accordingly upon connection of the gas supply to the main gas line 266 (at 90 p.s.i.g. or higher pressure), the line 266 is connected through the solenoid control valve 301 to the lines 303. The accumulator 265 is charged through the check valve 304 and the line 305 to essentially the pressure in the line 266. The pressure in the line 266 is also conveyed through the line 303 to place the spool valve 310 in the position illustrated. The pressure from the line 305 is applied through the spool valve 310 to the line 314, thus moving the valve actuators 261 and 281 to the open positions thereof, thus opening the associated valves 260 and 280, respectively, and thus opening the associated pipes 250 and 270, respectively, while closing the lading conduit at the coupling 275 therebetween. It is noted that the line 315 is vented at the spool valve 310 which is held in the position illustrated in FIG. 19 against its spring 313 by the pressure in the line 303.

Upon the associated fluid level sensor 295 detecting the loaded condition of the associated tank car, a signal is sent thereby to a terminal control system such as the terminal control system 420 in FIG. 1 and a return signal is received from the conductors 425 to shift the solenoid control valve 301 from the position illustrated in FIG. 19 to the position illustrated in FIG. 20. The main gas line 266 is now connected through the solenoid control valve 301 to the line 306 and the line 303 has no pressure applied thereto from the main line 266. Since there is no pressure applied to the line 303, the spring 313 in the spool valve 310 returns the spool 312 to the right as viewed in FIG. 20 and this connects the line 305 through the spool valve 310 to the line 315 and thus to pressurize the line 315. This serves to move the valve actuators 261 and 281 to close the associated valves 260 and 280, and thus to close the associated pipes 250 and 270, while opening the associated lading conduit therebetween. It is noted that the line 314 is not pressurized and is vented, thus allowing the closing of the valves 260 and 280. The pressure in the line 308 continues to charge the accumulator 265 to essentially the same pressure as in the main gas line 266. Since the spool 312 of the valve 310 is held in the position illustrated in FIG. 20 by the spring 313, gas from the accumulator 265 can also enter the line 315 to urge the valves 260 and 280 to the closed positions thereof.

Referring to FIGS. 1, 7–10, 19 and 20, a typical loading cycle using the loading system 400 to load a string of tank cars equipped with the control valves 260 and 280 and the valve control mechanism 300 will be described in detail. The string of tank cars 100A to 100C in FIGS. 7–10 is equipped with control valves 260 and 280 and a valve control mechanism 300 on each tank car (rather than the valves 160, 180 and 190 and the valve control mechanism 200 illustrated therein) and arrives in position on the rails 55 in an unloaded condition. The free end of the lading conduit disposed to the right has a cap thereon closing that end of the lading conduit and the lefthand end of the lading conduit also has a cap thereon. The cap on the righthand end of the lading conduit is removed and the loading conduit 60 is coupled thereto, and the cap on the lefthand end of the lading conduit is removed and the vapor line or conduit 65 is attached thereto. It will be appreciated that although the tank cars 100A to 100C are unloaded, there still remains therein a quantity of liquified compressed gas or at least the vapors thereof, which may typically have a pressure on the order of 100 p.s.i.g., whereby upon opening of the valves associated therewith an immediate pressure on the order of 100 p.s.i.g. is provided at the end of the conduits 60 and 65. The conduit 60 is connected to the outlet of the valve 408 for the pump 405 while the conduit 65 is connected to the input to the vapor recovery system 415. Accordingly, the entire system will immediately be under pressure on the order of 100 p.s.i.g. and there will be a minimal introduction of air or oxygen to the system, thus minimizing the likelihood of a fire of explosion. The nitrogen supply 410 is connected through the valve 413 to the main gas line 266 and pressure is applied thereto on the order of 90 p.s.i.g. Finally, the conductor 425 is connected to the solenoid control valves 301 and the conductor 426 from the terminal control system 420 is connected to the liquid level sensors 295.

When the tank cars 100A to 100C arrive for the loading operation, all of the control valves 260 and 280 are closed. Furthermore, the solenoid control valves 301 are in the position illustrated in FIG. 19 and the spool valves 310 are in the positions illustrated in FIG. 20 of the drawings. When the nitrogen supply 410 is connected to the main gas line 266, and the valve 413 opened, the high pressure gas will be directed by the solenoid control valves 301 to the lines 303 which will immediately begin charging the associated accumulators 265 and will move the spools 312 against the springs 313 in the spool valves 310 so as to connect the lines 305 to the lines 314. This will cause the valve actuators 261 and 281 to move so as to open the associated control valves 260 and 280 on all the cars in the train 50, the lines 315 being vented to the atmosphere through the spool valves 310.

Fluid lading, such as liquified petroleum gas, is now pumped from the supply 401 through the outlet pipe 402, the open valve 403, the pipe 406 via the pump 405 and then through the pipe 407 and the open valve 408 to the loading conduit 60 and then into the lading conduit 220. The fluid lading flows through the open valve 260A and down through the first pipe 250A and into the interior of the associated tank car 100A. The valve 280A is also open and the valves 260A and 280A close the lading conduit therebetween, whereby the fluid lading flows only through the first pipe 250A. The vapors generated during the loading operation of the tank car 100A pass upwardly through the second pipe 270A, and into that portion of the lading conduit disposed to the left of the control valves 260A and 280A and into the next tank car 100B, thus to vent and to equalize the pressure that might be therein. Since the valves 260 and 280 on the tank cars to the left of the tank car 100A are all open so as to close the lading conduit therebetween, the vapors will pass from car to car continually venting vapors therefrom and will exit through the vapor conduit 65 and thus to the input to the vapor recovery system 415. The recovered liquified compressed gas from the vapor recovery system 415 is conveyed by the pipe 416 to the input of the supply 401 of liquified compressed gas.

When the fluid level in the tank 110A reaches a predetermined point, the liquid level sensor 295A is activated and generates a control signal that is conveyed by the conductor 426 to the terminal control system 420. The terminal control system 420 in turn creates a control signal that is conveyed by the conductors 425 and is applied to the solenoid control valve 301 on the car 100A to move the parts thereof to the positions illustrated in FIG. 20. The main gas line 266 is now connected to the line 306 and through the check valve 307 to the line 308, whereby further to charge the accumulator 265. Pressure has been removed from the spool valve 310 and therefor the spring 313 moves the spool 312 to the position illustrated in FIG. 20 which vents gas pressure from the line 314 and applies gas under pressure from the line 305 to the line 315. This serves to move the valve actuators 261 and 281 to positions to close the associated valves 260A and 280A, respectively, and thus to close the pipes 250A and 270A, while opening the lading conduit therebetween. The tank car 100A is now loaded and the loading operation shifts to the car 100B since the valves 260B and 280B are open therein and the lading conduit disposed therebetween is closed thereby.

The liquified compressed gas now flows from the supply 401 under the urging of the pump 405 and through the open valves 403 and 408 into the loading conduit 60 and through the lading conduit on tank car 100A and into the righthand portion of the lading conduit on tank car 100B. Since the control valves 260B and 280B are open, the lading conduit therebetween is closed, and the lading is diverted and flows through the pipe 250B. The tank car 100B is then loaded in the same manner as was tank car 100A described above. When the tank car 100B is fully loaded, the liquid level sensor 295B senses the fully loaded condition and sends a signal by the conductor 426 to the terminal control system 420 which in turn generates a control signal that is conveyed along the conductors 425 to the solenoid control valve 301 associated with the tank car 100B. Actuation of the solenoid control valve 301 on the tank car 100B closes the control valves 260B and 280B, thus closing the associated pipes 250A and 270A and opening the lading conduit therebetween.

With the control valves 260A, 280A, 260B and 280B closed, a passage is now completed from the pump 405 through the valve 408 and the loading conduit 60 and through the lading conduits on the tank cars 100A and 100B and the associated connecting conduits to the righthand end of the lading conduit on the tank car 100C. The control valves 260C and 280C are open to open the associated pipes 250C and 270C while closing the lading conduit therebetween. Accordingly, the fluid lading is loaded into the tank car 100C through the first pipe 250C. Loading of the tank car 100C proceeds as described above with respect to the loading of the tank cars 100A and 100B until the liquid level sensor 295C senses the loaded condition of the tank car 100C. At this time the liquid level sensor 295C will produce a signal conveyed by the conductor 426 to the terminal control system 420 which in turn will generate a control signal conveyed by the conductors 425 to the solenoid control valve 301 on the tank car 100C. This will shift the solenoid control valve 301 on the tank car 100C from the position illustrated in FIG. 19 to that illustrated in FIG. 20. This will close the control valves 260C and 280C thus closing the associated pipes 250C and 270C while opening the lading conduit 220C therebetween. The string of cars at the loading system 400 is now completely loaded.

The lading conduits on the tank cars 100A, 100B and 100C are now purged of liquid and vapor. This is accomplished by closing the valve 408 and opening the valve 412, thus to supply nitrogen gas from the supply 410 thereof through the outlet pipe 411, the now open valve 412 and the loading conduit 60 and through the lading conduits outwardly through the conduit 65 to the inlet of the vapor recovery system 415. It will be understood that all of the valves 260 and 280 are closed at this time to close the associated pipes and to open the associated lading conduits therebetween, the solenoid control valves 301 being in the positions illustrated in FIG. 20. After the purging, the valve 412 is closed and the loading conduit 60 is disconnected from the righthand end of the lading conduit and a cap is placed thereon. Likewise, the conduit 65 is removed from the lefthand end of the lading conduit and a cap placed on the free end of the lading conduit. The connection between the valve 413 and the main gas line 266 is removed and the conductors 425 and 426 are disconnected from the adjacent car 100A. Disconnection of the gas supply from the main gas line 266 removes the pressure from the line 306 (see FIG. 20). Summarizing, all the valves 260 and 280 along the entire length of the train 50 are now in the closed positions thereof. These valves all remain in the closed positions during the transport of the train 50 to the point of unloading.

Referring to FIGS. 2, 11–14, 19 and 20, a typical unloading cycle using the unloading system 500 to unload a train of tank cars 100 equipped with the control valves 260 and 280 and the valve control mechanisms 300 will be described in detail. When the loaded tank cars arrive on the tracks 55 in FIG. 2, the solenoid control valves 301 are in the positions illustrated in FIG. 20, and since no pressure is applied to the line 266, all of the valves 260 and 280 are closed and are further urged into the closed positions by the air pressure provided from the accumulator 265 through the line 315. The unloading conduit 80 is connected to the righthand end of the lading conduit and is connected to the valve 505 and the line 502 to the inlet for the container 501 of liquified compressed gas. The conductor 525 from the terminal control system 520 is connected to the conductors for the solenoid control valves 301 and the conductor 526 is connected to the liquid level sensors 295. The supply 510 of nitrogen under pressure is connected by the pipe 511 through the valve 513 to the main gas line 266. Finally the valve 519 is connected to the unloading conduit 85 attached to the lefthand end of the lading conduit 120C. Upon opening of the valve 513, pressure will be applied to the line 266 and as is best illustrated in FIG. 20 of the drawings, pressure will then be applied through the solenoid control valves 301 to the lines 306 which through the check valves 307 and the lines 308 charge the accumulators 265. The lines 305 are also connected to the spool valves 310 to pressurize the lines 315, thus to hold the valve actuators 261 and 281 and the associated valves 260 and 280 closed. Opening of the valves 518 and 519 now applies the commodity gas vapors under pressure from the compressor 515 to the lefthand end of the lading conduit 120C.

At this time the operator causes a control signal to be generated by the terminal control system 520 and conveyed along the conductor 525 to the solenoid control valve 301 on the tank car 100C. This control signal shifts the solenoid control valve 301 from the position illustrated in FIG. 20 to that illustrated in FIG. 19. As a consequence, the control valves 260C and 280C are opened, thus to open the associated pipes 250C and 270C and to close the lading conduit 220C therebetween. The fluid lading is then forced by the pressure of the supply 510 from the tank 100C up through the pipe 250C and into the righthand portion of the associated lading conduit and then through the interconnected lading conduits on the tank cars 100B and 100A and the associated connecting conduits 230 to the right and to the unloading conduit 80. This action will continue until the tank car 100C is unloaded, it being noted that the lading therefrom flows directly into the container 501 without entering any of the other tank cars in the train 50.

When the tank car 100C is unloaded, the liquid level sensor 295C is activated and generates a control signal that is conveyed by the conductor 526 to the terminal control system 520. The terminal control system 520 in turn creates a control signal that is conveyed by the conductors 525 and is applied to the solenoid control valve 301 on the tank car 100B which shifts the solenoid control valve 301 on the tank car 100B from the position illustrated in FIG. 20 to the position illustrated in FIG. 19. As a consequence, the control valves 260B and 280B are opened, thus to open the associated pipes 250B and 270B while closing the associated lading conduit therebetween. The fluid lading is then forced by the pressure of the supply 510 from the tank 110B up the pipe 250B and into the righthand portion of the lading conduit and then through the interconnecting lading conduit on the tank car 100A and the associated connecting conduit 130 to the right and to the unloading conduit 80. This action will continue until the tank car 100B is unloaded, it being noted that the liquid lading therefrom flows directly into the container 501 without entering any of the other tank cars in the train 50.

When the tank car 100B is unloaded, the liquid level sensor 295B is activated and generates a control signal that is conveyed by the conductor 526 to the terminal control system 520. The terminal control system 520 in turn creates a control signal that is conveyed by the conductors 525 and applied to the solenoid control valve 301 on the car 100A to move the parts thereof from the positions illustrated in FIG. 20 to the positions illustrated in FIG. 10. As a consequence, the control valves 260A and 280A are opened, thus to open the associated pipes 250A and 270A while closing the lading conduit 220A therebetween. The fluid lading is then forced by the pressure of the supply 510 from the tank 110A up through the pipe 250A and into the righthand portion of the lading conduit 220A and then to the unloading conduit 80. This action will continue until the tank car 100A is unloaded, it being noted that the lading therefrom flows directly to the container 501 without entering into the other tank cars on the train 50.

With all the tank cars 100A, 100B and 100C now unloaded, it will be noted that the valves 260A, 260B, 260C, 280A, 280B and 280C are all open. Disconnection of the valve 519 from the unloading conduit 85 and disconnection of the nitrogen supply 510 from the main gas line 266 leaves the control solenoids 301 in the position illustrated in FIG. 19 and removes pressure from the lines 303, whereby the spool valves 310 are returned by the springs 313 to the position illustrated in FIG. 20. The pressure in the accumulators 265 applied through the lines 305 to the lines 315 moves the valve actuators 261 and 281 and the associated control valves 260 and 280 all to the closed positions. The control valves 260 and 280 now effectively close the associated pipes 250 and 270 and open the associated lading conduits along the entire length thereof. The valves 260 and 280 will remain in the closed positions thereof during the transport of the unloaded train 50 to the point of loading.

Tank cars equipped with the control valves 260 and 280 and associated valve control mechanism 300 illustrated in FIGS. 15, 16, 19 and 20 generally have the benefits and advantages of the tank cars described above with respect to FIGS. 3–14, 17 and 18.

While there have been described what are at present considered to be the preferred embodiments of the invention, it will be understood that various modifications may be made therein, and it is intended to cover in the appended claims all such modifications as fall within the true spirit and scope of the invention.

What is claimed is:

1. A railway tank car adapted for interconnection in fluid communication with associated like tank cars by flexible connecting conduits for singly and sequentially loading the tank cars with fluid lading and singly and sequentially unloading the tank cars of fluid lading, said tank car comprising a tank for holding fluid lading, a wheeled chassis structure mounting said tank with chassis coupling means for coupling to the chassis of associated like cars, a lading conduit on said tank extending substantially the length thereof and having coupling means on the ends thereof, said coupling means coupling to associated flexible connecting conduits to place said lading conduit in fluid communication with the lading conduits of adjacent like tank cars, a first control valve in said lading conduit for selectively opening and closing said lading conduit, a first pipe in communication with said lading conduit on one side of said first control valve and extending into said tank and terminating at an open end adjacent to the bottom of said tank, a second control valve in said first pipe for selectively opening and closing said first pipe, a second pipe in communication with said lading conduit on the other side of said first control valve and extending into said tank, a third control valve in said second pipe for selectively opening and closing said second pipe, and valve control mechanism operatively connected to said control valves for closing said first control valve and opening said second and third control valves to accommodate loading of fluid lading into said tank and to accommodate unloading of fluid lading from said tank and for closing said first and second and third control valves for transporting of said tank.

2. The railway tank car set forth in claim 1, wherein said second pipe terminates in an open end spaced a predetermined distance from the top of said tank.

3. The railway tank car set forth in claim 1, and further comprising a third pipe in communication with said lading conduit and terminating in an open end spaced a predetermined distance below the open end of said second pipe, and a valve mechanism in said third pipe.

4. The railway tank car set forth in claim 1, and further comprising a fluid level gauge mounted in said tank for detecting the loaded condition thereof to actuate said valve mechanisms to open said lading conduit and to close said first and second pipes and for detecting the unloaded condition of said tank.

5. The railway tank car set forth in claim 1, and further comprising a fluid level gauge mounted in said tank for detecting a first loaded condition thereof to actuate said valve mechanisms to open said lading conduit and to close said first and second pipes at a first level of fluid lading within said tank and for detecting a second loaded condition thereof to actuate said valve mechanisms to open said lading conduit and to close said first and second pipes at a second level of fluid lading within said tank and for detecting the unloaded condition of said tank.

6. The railway tank car set forth in claim 1, wherein said lading conduit and said control valves are mounted on top of said tank.

7. The railway tank car set forth in claim 6, and further comprising a protective housing mounted on the top of said tank and surrounding said control valves.

8. The railway tank car set forth in claim 1, and further comprising a visual indicator to give a visual signal as to whether said control valves are in the loading or unloading conditions thereof.

9. The railway tank car set forth in claim 1, wherein all of said control valves are ball valves with double-acting pneumatic actuators.

10. A railway tank car adapted for interconnection in fluid communication with associated like tank cars by flexible connecting conduits for singly and sequentially loading the tank cars with fluid lading and singly and sequentially unloading the tank cars of fluid lading, said tank car comprising a tank for holding fluid lading, a wheeled chassis structure mounting said tank with chassis coupling means for coupling to the chassis of associated like cars, a lading conduit on said tank extending substantially the length thereof and having coupling means on the ends thereof, said coupling means coupling to associated flexible connecting conduits to place said lading conduit in fluid communication with the lading conduits of adjacent like tank cars, a first pipe in communication with said lading conduit extending into said tank and terminating at an open end adjacent to the bottom of said tank, a first control valve for opening and closing said lading conduit and said first pipe, a second pipe in communication with said lading conduit at a point spaced from said first pipe and extending into said tank, a second control valve for opening and closing said lading conduit and said second pipe, and valve control mechanism operatively connected to said control valves for actuating said control valves to a first condition to close said lading conduit between said first and second pipes and to open said first and second pipes to accommodate loading of fluid lading into said tank and to accommodate unloading of fluid lading from said tank and to a second condition for closing said first and second pipes for transporting of said tank.

11. The railway tank car set forth in claim 10, wherein said lading conduit and said control valves are mounted on the top of said tank.

12. The railway tank car set forth in claim 11, and further comprising a protective housing mounted on the top of said tank and surrounding said control valves.

13. The railway tank car set forth in claim 10, wherein said first control valve is at the junction of said lading conduit and said first pipe, and said second control valve is at the junction of said lading conduit and said second pipe.

14. The railway tank car set forth in claim 10, and further comprising a liquid level sensor for detecting the loaded condition of said tank and for detecting the unloaded condition for said tank.

15. The railway tank car set forth in claim 14, wherein said liquid level sensor can detect two different loaded levels in said tank.

16. A railway tank car train for singly and sequentially loading the tank cars with fluid lading and singly and sequentially unloading the tank cars of fluid lading, said train comprising a plurality of railway tank cars connected in tandem relationship, each of said tank cars including a tank for holding fluid lading, a wheeled chassis structure mounting each of said tanks with chassis coupling means for coupling said car together, a lading conduit on each of said tanks extending substantially the length thereof and having coupling means on the ends thereof, a plurality of flexible connecting conduits respectively extending between adjacent coupled ones of said tank cars and coupled to said coupling means on said lading conduits, a first control valve in each lading conduit for selectively opening and closing the associated lading conduit, each of said tanks having a first pipe in communication with the associated lading conduit on one side of the associated first control valve and extending into said tank and terminating at an open end adjacent to the bottom thereof, a second control valve in each first pipe for selectively opening and closing the associated first pipe, each of said tanks having a second pipe in communication with the associated lading conduit on the other side of the associated first control valve and extending into said tank, a third control valve in each second pipe for selectively opening and closing the associated second pipe, and valve control mechanisms on each of said tanks operatively connected to the associated control valves for opening and closing the associated control valves, to accommodate the loading of said railway tank car train the free end of the lading conduit adjacent to the associated first pipe at one end of said train being connected to a source of fluid lading and said valve control mechanisms being actuated to close the associated first control valves and to open the associated second and third control valves and thereafter to fill the tank at said one end of said train and upon filling of the tank the associated valve control mechanism opening the associated first control valve and closing the associated second and third control valves to transfer the loading operation to the next tank in said train for loading in the same manner as the tank at said one end of said train until all of the tanks in said train have been loaded singly and in sequence from said one end of said train to the other end of said train, to accommodate the unloading of said railway tank car train the free end of the lading conduit at the one end of said train being connected to a container for the fluid lading and the free end of the lading conduit at the other end of said train being connected to a source of gas under pressure and all said valve control mechanisms are actuated to open all said first valves and said valve control mechanism for the tank at said other end of said train is actuated to close the associated first control valve and to open the associated second and third control valves on the tank at said other end of said train and thus to remove the fluid lading therefrom through said lading conduit and thereafter the valve control mechanism for the next tank in said train is actuated to close the associated first control valve and to open the associated second and third control valves for said next tank in said train and thus to remove the fluid lading from said tanks in said train singly and in sequence from said other end of said train to said one end of said train, for transporting of said train said valve control mechanisms then closing said second and said third control valves.

17. The railway tank car train set forth in claim 16, wherein each of said second pipes terminates in an open end spaced a predetermined distance from the top of said tank.

18. The railway tank car train set forth in claim 16, and further comprising a third pipe for each of said tanks in communication with said loading conduit and terminating in an open end spaced a predetermined distance below the open end of the associated second pipe, and a valve mechanism in each of said third pipes.

19. The railway tank car train set forth in claim 16, wherein said lading conduits and said control valves are mounted on the top of the associated tank.

20. The railway tank car train set forth in claim 19, and further comprising a protective housing mounted on the top of each of said tanks and surrounding the associated control valves.

21. The railway tank car train set forth in claim 16, and further comprising a visual indicator to give a visual signal as to whether each of said control valves is in the open or closed position thereof.

22. The railway tank car train set forth in claim 16, wherein all of said control valves are ball valves with double-acting pneumatic actuators.

23. The railway tank car train set forth in claim 16, and further comprising fluid level sensor means for each of said tanks for detecting the loaded condition thereof and the unloaded condition thereof, detection of the loaded condition of the associated tank by said fluid level sensor means causing the associated valve control mechanism to open the associated first control valve and to close the associated second and third control valves to transfer the loading operation to the next tank in said train, the detection of the unloaded condition of the associated tank by said fluid level sensor means actuating the valve control mechanism for the next tank in said train to close the associated first control valve and to open the associated second and third control valves for said next tank in said train.

24. The railway tank car train set forth in claim 23, wherein said fluid level sensor means can detect two different loaded conditions of the associated tank.

25. A railway tank car train for singly and sequentially loading the tank cars with fluid lading and singly and sequentially unloading the tank cars of fluid lading, a plurality of railway tank cars connected in tandem relationship, each of said tank cars including a tank for holding fluid lading, a wheeled chassis structure mounting each of said tanks with chassis coupling means for coupling said cars together, a lading conduit on each of said tanks extending substantially the length thereof and having coupling means on the ends thereof, a plurality of flexible connecting conduits respectively extending between adjacent coupled ones of said tank cars and coupled to said coupling means on said lading conduits, each of said tanks having a first pipe in communication with the associated lading conduit and extending into said tank and terminating at an open end adjacent to the bottom thereof, a first control valve for opening and closing the associated lading conduit and the associated first pipe, each of said tanks having a second pipe in communication with the associated lading conduit at a point spaced from said first pipe and extending into said tank, a second control valve for opening and closing the associated lading conduit and the associated second pipe, and valve control mechanism operatively connected to said control valves for actuating said control valves to a first position opening the associated lading conduit and closing the associated first and second pipes and for actuating said control valves to a second position closing the associated lading conduit and opening the associated first and second pipes, to accommodate the loading of said railway tank car train the free end of the lading conduit adjacent to the associated first pipe at one end of said tank train being connected to a source of fluid lading and said valve control mechanism on the tank car at said one end of said train is actuated to move said first and second control valves to the second positions thereof to close the associated lading conduit and to open the associated first and second pipes and thus to fill the tank at said one end of said train and upon filling of the tank the associated valve control mechanism actuating the associated first and second control valves to the first positions thereof to open the associated lading conduit and to close the associated first and second pipes and to transfer the loading operation to the next tank in said train for loading in the same manner as the tank at said one end of said train until all the tanks in said train have been loaded singly and in sequence from said one end of said train to said other end of said train, to accommodate the unloading of said railway tank car train the free end of the lading conduit at the one end of said train being connected to a container for the fluid lading and the free end of the lading conduit at the other end of said train being connected to a source of gas under pressure and said valve control mechanism for the last tank on the other end of said train is actuated to move said first and second control valves to the second positions thereof to close said lading conduit and to open said first and second pipes on the last tank at said other end of said train and thus to remove the fluid lading therefrom through said lading conduit and thereafter the valve control mechanism for the next tank in said train is actuated to move said first and second control valves to the second positions thereof to close the associated lading conduit and to open said first and second pipes on said next tank in said train and thus to remove the fluid lading from said tanks in said train singly and in sequence from said other end of said train to said one end of said train, for transporting of said train said valve control mechanisms operating said first and second control valves to the first positions thereof closing said first and second pipes.

26. The railway tank car train set forth in claim 25, wherein said lading conduits and said control valves are mounted on the top of the associated tank.

27. The railway tank car train set forth in claim 25, and further comprising a protective housing mounted on the top of each of said tanks and surrounding the associated control valves.

28. The railway tank car train set forth in claim 25, wherein said first control valves are at the junctions of the associated lading conduits and the associated first pipes, and said second control valves are at the junctions of the associated lading conduits and the associated second pipes.

29. The railway tank car train set forth in claim 25, and further comprising fluid level sensor means for each of said tanks for detecting the loaded condition thereof and the unloaded condition thereof, detection of the loaded condition of the associated tank by said fluid level sensor means causing the associated valve control mechanism to actuate the associated first and second control valves to the first position thereof to open the associated lading conduit and to close the associated first and second pipes and to transfer the loading operation to the next tank in said train, detection of the unloaded condition of the associated tank by said fluid level sensor causing the valve control mechanism for the next tank in said train to be actuated to move said first and second control valves to the second positions thereof to close the associated lading conduit and to open said first and second pipes on said next tank in said train.

30. The railway tank car train set forth in claim 29, wherein said fluid level sensors means can detect two different loaded conditions of the associated tank.

31. A loading system for railway tank car trains for singly and sequentially loading the tank cars with fluid lading, said loading system comprising a supply of fluid lading having an outlet therefor and an inlet therefor, a pump having the inlet thereof connected to said supply outlet and having an outlet, a vapor recovery system having an inlet and an outlet connected to said supply inlet, a terminal control system having a control signal terminal and a fluid level signal terminal, and structure accommodating a railway tank car train having a plurality of railway tank cars connected in tandem relationship, each of the associated tank cars including a tank for holding fluid lading, a wheeled chassis structure mounting each of the associated tanks with chassis coupling means for coupling the associated cars together, a lading conduit on each of the associated tanks extending substantially the length thereof and having coupling means at the ends thereof, a plurality of flexible connecting conduits respectively extending between adjacent coupled ones of the associated tank cars and coupled to the coupling means on the lading conduit, each of the tanks having a first pipe in communication with the associated lading conduit and extending into the associated tank and terminating at an open end adjacent to the bottom thereof, each of the associated tanks having a second pipe in communication with the associated lading conduit at a point spaced from the first pipe and extending into the associated tank, valve mechanism on each of the associated tanks for selectively closing and opening the lading conduit and the first and second pipes, and a fluid level sensor for each of the tanks for detecting the loaded condition thereof, to accommodate the loading of the associated railway tank car train the free end of the lading conduit adjacent to the associated first pipe at one end of the train being connected to the outlet of said pump and the valve mechanisms being connected to the control signal terminal of said terminal control system and the fluid level sensors being connected to the fluid level signal terminal of said terminal control system and the free end of the lading conduit adjacent to the associated second pipe at the other end of the associated train being connected to the inlet to said vapor recovery system, said terminal control system actuating the valve mechanisms on at least the tank car at the one end of the associated train to close the associated lading conduit between the associated first and second pipes and to open the associated first and second pipes and thus to fill the tank at said one end of the associated train from said supply of fluid lading, filling the tank providing a signal from the associated fluid level sensor to said terminal control system that in turn provides a signal from the control signal terminal thereof to the valve mechanism on the tank car at the one end of the train to open the associated lading conduit and to close the associated first and second pipes and to transfer the loading operation to the next tank in the train until all of the tanks in the train have been loaded singly and in sequence from the one end of the train to said other end of the train, disconnection of the lading conduit from the outlet of said pump and the inlet to said vapor recovery system and disconnection of the valve mechanisms and the fluid level sensors from said terminal control system to place the railway tank car train in readiness for transporting.

32. The loading system set forth in claim 31, wherein said supply of fluid lading is high pressure liquified gases.

33. The overloading system set forth in claim 31, wherein said supply of fluid lading is liquified petroleum gases.

34. The loading system set forth in claim 31, wherein said terminal control system is electrically operated.

35. The loading system set forth in claim 31, wherein the valve mechanisms are both pneumatically and electrically operated.

36. The loading system set forth in claim 31, wherein said fluid level sensor can detect a first loaded condition of the associated tank at a first level of fluid lading within the tank and can detect a second loaded condition of the tank at a second level of fluid lading within the tank.

37. The loading system set forth in claim 31, and further comprising a supply of gas under pressure for providing pneumatic pressure to the valve mechanisms and for providing gas to purge the lading conduit at the completion of the loading operation.

38. A loading system for railway tank car trains for singly and sequentially loading the tank cars with fluid lading, said loading system comprising a supply of fluid lading having and outlet therefor and an inlet therefor, a pump having the inlet thereof connected to said supply outlet and having an outlet, a vapor recovery system having an inlet and an outlet connected to said supply inlet, a terminal control system having a control signal terminal and a fluid level signal terminal, and structure accommodating a railway tank car train having a plurality of railway tank cars connected in tandem relationship, each of the associated tank cars including a tank for holding fluid lading, a wheeled chassis structure mounting each of the associated tanks with chassis coupling means for coupling the associated cars together, a lading conduit on each of the associated tanks extending substantially the length thereof and having coupling means at the ends thereof, a plurality of flexible connecting conduits respectively extending between adjacent coupled ones of the associated tank cars and coupled to the coupling means on the lading conduit, a first control valve for selectively opening and closing the associated lading conduit, each of the tanks having a first pipe in communication with the associated lading conduit on one side of the associated first control valve and extending into the tank and terminating at an open end adjacent to the bottom thereof, a second control valve for selectively opening and closing the associated first pipe, each of the tanks having a second pipe in communication with the associated lading conduit on the other side of the associated first control valve and extending into the tank, a third control valve for selectively opening and closing the associated second pipe, valve control mechanisms on each of the tanks operatively connected to the associated control valves for opening and closing the associated control valves, and a fluid level sensor for each of the tanks for detecting the loaded condition thereof to accommodate the loading of the associated railway tank car train the free end of the lading conduit adjacent to the associated first pipe at one end of the train being connected to the outlet of said pump and the valve control mechanisms being connected to the control signal terminal of said terminal control system and the fluid level sensors being connected to the fluid level signal terminal of said terminal control system and the free end of the lading conduit adjacent to the associated second pipe at the other end of the associated train being connected to the inlet to said vapor recovery system, said terminal control system actuating all the valve control mechanisms on the associated tanks to cause the first control valves to close the associated lading conduits and to cause said second and third control valves to open the associated first and second pipes and thus to fill the tank at said one end of said train from said supply of fluid lading, filling of the tank providing a signal from the associated fluid level sensor to said terminal control system that in turn provides a signal from the control signal terminal thereof to the valve control mechanism on the tank car on the one end of the train to open the associated first control valve and to close the associated second and third control valves and to transfer the loading operation to the next tank in the train for loading in the same manner as the tank at the one end of the train until all of the tanks in the train have been loaded singly and in sequence from the one end of the train to the other end of the train, disconnection of said lading conduit from the outlet of said pump and the inlet to said vapor recovery system and disconnection of the valve control mechanisms and the fluid level sensors from said terminal control system closing the first control valves to place the railway tank car train in readiness for transporting.

39. The loading system set forth in claim 38, wherein said terminal control system is electrically operated.

40. The loading system set forth in claim 38, wherein the valve control mechanisms are both pneumatically and electrically operated.

41. The loading system set forth in claim 38, wherein said fluid level sensor can detect a first loaded condition of the associated tank at a first level of fluid lading within the tank and can detect a second loaded condition of the tank at a second level of fluid lading within the tank.

42. The loading system set forth in claim 38, and further comprising a supply of gas under pressure for providing pneumatic pressure to the valve control mechanisms and for providing gas to purge the lading conduit at the completion of the loading operation.

43. The loading system set forth in claim 38, wherein each of said valve control mechanisms includes a first valve actuator for the associated first control valve and a second valve actuator for the associated second control valve and a third valve actuator for the associated third control valve, a solenoid control valve having an inlet for connection to a source of gas under pressure and a load outlet and an unload outlet selectively connectable to said inlet, an accumulator for compressed gases connected to the associated load outlet and unload outlet for accumulating gas under pressure for operation of the associated valve actuators, a first pilot valve connected to the associated unload outlet and accumulator and to the associated first valve actuator for selectively applying gas under pressure to the associated first valve actuator to control the position of the first control valve, and a second pilot valve connected to the associated load outlet and accumulator and the associated second and third control valves for selectively applying gas under pressure to the associated second and third valve actuators for controlling the positions thereof and the associated second and third control valves.

44. A loading system for railway tank car trains for singly and sequentially loading the tank cars with fluid lading, said loading system comprising a supply of fluid lading having an outlet therefor and an inlet therefor, a pump having the inlet thereof connected to said supply outlet and having an outlet, a vapor recovery system having an inlet and an outlet connected to said supply inlet, a terminal control system having a control signal terminal and a fluid level signal terminal, and structure accommodating a railway tank car train having a plurality of railway tank cars connected in tandem relationship, each of the associated tank cars including a tank for holding fluid lading, a wheeled chassis structure mounting each of the associated tanks with chassis coupling means for coupling the associated cars together, a lading conduit on each of the associated tanks extending substantially the length thereof and having coupling means at the ends thereof, a plurality of flexible connecting conduits respectively extending between adjacent coupled ones of the associated tank cars and coupled to the coupling means on the lading conduit, each of the tanks having a first pipe in communication with the associated lading conduit and extending into the associated tank and terminating at an open end adjacent to the bottom thereof, a first control valve for opening and closing the associated lading conduit and the associated first pipe, each of the associated tanks having a second pipe in communication with the associated lading conduit at a point spaced from the first pipe and extending into the associated tank, a second control valve for opening and closing the associated lading conduit and the associated second pipe, valve control mechanism operatively connected to the first and second control valves for actuating the control valves to a first position opening the associated lading conduit and closing the associated first and second pipes and for actuating the control valves to a second position closing the associated lading conduit and opening the associated first and second pipes, and a fluid level sensor for each of said tanks for detecting the loaded condition thereof, to accommodate the loading of the associated railway tank car train the free end of the lading conduit adjacent to the associated first pipe at one end of the train being connected to the outlet of said pump and the valve control mechanisms being connected to the control signal terminal of said terminal control system and the fluid level sensors being connected to the fluid level signal terminal of said terminal control system and the free end of the lading conduit adjacent to the associated second pipe at the other end of the associated train being connected to the inlet to said vapor recovery system, a signal from the control signal terminal of said terminal control system actuating the valve control mechanism on the tank car at the one end of the associated train to move the first and second control valves to the second positions thereof to close the associated lading conduit and to open the associated first and second pipes and thus to fill the tank at the one end of the associated train from said supply of said fluid lading, filling of the tank providing a signal from the associated fluid level sensor to said terminal control system that in turn provides a signal from the control signal terminal thereof to the valve control mechanism on the tank car at the one end of the train actuating the associated first and second control valves to the first positions thereof to open the associated lading conduit and to close the associated first and second pipes and thus to fill the next tank in the train in the same manner as the tank at the one end of the train until all the tanks in the train have been loaded singly and in sequence from the one end of the train to the other end of the train, disconnection of said lading conduit from the outlet of said pump and the inlet to said vapor recovery system and disconnection of the valve mechanisms and the fluid level sensors from said terminal control system to place the railway tank car train in readiness for transporting.

45. The loading system set forth in claim 44, wherein said terminal control system is electrically operated.

46. The loading system set forth in claim 44, wherein the valve control mechanisms are both pneumatically and electrically operated.

47. The loading system set forth in claim 44, wherein said fluid level sensor can detect a first loaded condition of the associated tank at a first level of fluid lading within the tank and can detect a second loaded condition of the tank at a second level of fluid lading within the tank.

48. The loading system set forth in claim 44, and further comprising a supply of gas under pressure for providing pneumatic pressure to the valve control mechanisms and for providing gas to purge the lading conduit at the completion of the loading operation.

49. The loading system set forth in claim 44, wherein each of said valve control mechanisms includes a first valve actuator for the associated first control valve and a second valve actuator for the associated second control valve, a solenoid control valve having an inlet for connection to a source of gas under pressure and a load outlet and an unload outlet selectively connectable to said inlet, an accumulator for compressed gases connected to said load outlet and said unload outlet for accumulating gas under pressure for operation of the associated valve actuators, a pilot valve connected to said load outlet and said accumulator and to said first and second valve actuators for selectively applying gas under pressure to said first and second valve actuators for controlling the positions thereof and the associated first and second control valves, and a connection between said unload outlet and said accumulator.

50. An unloading system for railway tank car trains for singly and sequentially unloading the tank cars of fluid lading, said unloading system comprising a container for fluid lading having an inlet and an outlet therefor, a source of compressed gas under pressure having an outlet therefor, a terminal control system having a control signal terminal and a fluid level signal terminal, and structure accommodating a railway tank car train having a plurality of railway tank cars connected in tandem relationship, each of the associated tank cars including a tank for holding fluid lading, a wheeled chassis structure mounting each of the associated tanks with chassis coupling means for coupling the associated cars together, a lading conduit on each of the associated tanks extending substantially the length thereof and having coupling means at the ends thereof, a plurality of flexible connecting conduits respectively extending between adjacent coupled ones of the associated tank cars and coupled to the coupling means on the lading conduits, each of the tanks having a first pipe in communication with the associated lading conduit and extending into the associated tank and terminating at an open end adjacent to the bottom thereof, each of the associated tanks having a second pipe in communication with the associated lading conduit at a point spaced from the first pipe and extending into the associated tank, valve mechanism on each of the associated tanks for respectively closing and opening the lading conduit and the first and second pipes, and a fluid level sensor for each of the tanks for detecting the unloaded condition thereof, to accommodate the unloading of the associated railway tank car train the free end of the lading conduit at one end of the train being connected to the inlet for said container for fluid lading and the free end of the lading conduit at the other end of the train being connected to the outlet of said source of gas under pressure and the valve control mechanisms being connected to the control signal terminal of said terminal control system and the fluid level sensors being connected to the fluid level signal terminal of said terminal control system, an unload signal from the control signal terminal of said terminal control system actuating the valve mechanism on the tank at the other end of the associated train to close the associated lading conduit between the first and second pipes and to open the first and second pipes on the tank at the other end of the train and thus to remove the fluid lading therefrom through the lading conduit to the inlet of said container for fluid lading, detection of the unloaded condition of the tank at the other end of the train by the associated fluid level sensor providing a signal to the fluid level signal terminal of said terminal control system that in turn provides a signal from the control signal terminal thereof to the valve mechanism on the next tank in the train to close the associated lading conduit between the first and second pipes and to open the first and second pipes on the next tank in the train and thus to remove the fluid lading from the tanks in the train singly and in sequence from the other end of the train to the one end of the train, disconnection of said lading conduit from the inlet to said container for liquid lading and disconnection of the lading conduit from the outlet of said supply of gas under pressure and disconnecting of the valve mechanisms and the fluid level sensors from said terminal control system closing the first and second pipes to place the railway tank car train in readiness for transporting.

51. The unloading system set forth in claim 50, wherein said supply of fluid lading is high pressure liquified gases.

52. The unloading system set forth in claim 50, wherein said supply of fluid lading is liquified petroleum gases.

53. The unloading system set forth in claim 50, wherein said terminal control system is electrically operated.

54. The unloading system set forth in claim 50, wherein the valve mechanisms are both pneumatically and electrically operated.

55. An unloading system for railway tank car trains for singly and sequentially unloading the tank cars of fluid lading, said unloading system comprising a container for fluid lading having an inlet and an outlet therefor, a compressor having an inlet connected to said container outlet and said compressor having an outlet therefor, a terminal control system having a control signal terminal and a fluid level signal terminal, and structure accommodating a railway tank car train having a plurality of railway tank cars connected in tandem relationship, each of the associated tank cars including a tank for holding fluid lading, a wheeled chassis structure mounting each of the associated tanks with chassis coupling means for coupling the associated cars together, a lading conduit on each of the associated tanks extending substantially the length thereof and having coupling means at the ends thereof, a plurality of flexible connecting conduits respectively extending between adjacent coupled ones of the associated tank cars and coupled to the coupling means on the lading conduits, each of the tanks having a first control valve for selectively opening and closing the associated lading conduit, each of the tanks having a first pipe in communication with the associated lading conduit on one side of the associated first control valve and extending into the tank and terminating at an open end adjacent to the bottom thereof, a second control valve for selectively opening and closing the associated first pipe, each of the tanks having a second pipe in communication with the associated lading conduit on the other side of the associated first control valve and extending into the tank, a third control valve for selectively opening and closing the associated second pipe, valve control mechanisms on each of the tanks operatively connected to the associated control valves for opening and closing the associated control valves, and a fluid level sensor for each of the tanks for detecting the unloaded condition thereof, to accommodate the unloading of the associated railway tank car train the free end of the lading conduit at one end of the train being connected to the inlet for said container for fluid lading and the free end of the lading conduit at the other end of the train being connected to the outlet of said compressor and the valve mechanisms being connected to the control signal terminal of said terminal control system to open all of the first valves on all of the associated tanks and the fluid level sensors being connected to the fluid level signal terminal of said terminal control system, an unload signal from the control signal terminal of said terminal control system actuating the valve control mechanism on the tank at the other end of the associated train to close the first control valve to close the associated lading conduit between the first and second pipes and to open the second valve and the third valve on the tank at the other end of the train to open the first and second pipes thereof and thus to remove the fluid lading therefrom through the lading conduit to the inlet of said container for fluid lading, detection of the unloaded condition of the tank at the other end of the train by the associated fluid level sensor providing a signal to the fluid level signal terminal of said terminal control system that in turn provides a signal from the control signal terminal thereof to the valve control mechanism on the next tank in the train to close the first valve in the associated lading conduit between the first and second pipes and to open the second and third valves and the associated first and second pipes on the next tank in the train and thus to remove the fluid lading from the tanks in the train singly and in sequence from the other end of the train to the one end of the train, disconnection of said lading conduit from the inlet to said container for fluid lading and disconnection of the lading conduit from the outlet of said compressor and disconnection of the valve control mechanisms and the fluid level sensors from said terminal control system closing the second and third control valves to close the associated lading conduit and the associated first and second pipes to place the railway tank car train in readiness for transporting.

56. The unloading system set forth in claim 55, wherein said terminal control system is electrically operated.

57. The unloading system set forth in claim 55, wherein the valve mechanisms are both pneumatically and electrically operated.

58. The unloading system set forth in claim 55, wherein each of said valve control mechanisms includes a first valve actuator for the associated first control valve and a second valve actuator for the associated second control valve and a third valve actuator for the associated third control valve, a solenoid control valve having an inlet for connection to a source of gas under pressure and a load outlet and an unload outlet selectively connectable to said inlet, an accumulator for compressed gases connected to the associated load outlet and unload outlet for accumulating gas under pressure for operation of the associated valve actuators, a first pilot valve connected to the associated unload outlet and accumulator and to the associated first valve actuator for selectively applying gas under pressure to the associated first valve actuator to control the position of the first control valve, and a second pilot valve connected to the associated load outlet and accumulator and the associated second and third control valves for selectively applying gas under pressure to the associated second and third valve actuators for controlling the positions thereof and the associated second and third control valves.

59. An unloading system for railway tank car trains for singly and sequentially unloading the tank cars of fluid lading, said unloading system comprising a container for fluid lading having an inlet therefor, a source of compressed gas under pressure having an outlet therefor, a terminal control system having a control signal terminal and a fluid level signal terminal, and structure accommodating a railway tank car train having a plurality of railway tank cars connected in tandem relationship, each of the associated tank cars including a tank for holding fluid lading, a wheeled chassis structure mounting each of the associated tanks with chassis coupling means for coupling the associated cars together, a lading conduit on each of the associated tanks extending substantially the length thereof and having coupling means at the ends thereof, a plurality of flexible connecting conduits respectively extending between adjacent coupled ones of the associated tank cars and coupled to the coupling means on the lading conduits, each of the tanks having a first pipe in communication with the associated lading conduit and extending into the associated tank and terminating at an open end adjacent to the bottom thereof, a first control valve for opening and closing the associated lading conduit and the associated first pipe, each of the associated tanks having a second pipe in communication with the associated lading conduit at a point spaced from the first pipe and extending into the associated tank, a second control valve for opening and closing the associated lading conduit and the associated second pipe, valve control mechanism operatively connected to the first and second control valves for actuating the control valves to a first position opening the associated lading conduit and closing the associated first and second pipes and for actuating the control valves to a second position closing the associated lading conduit and opening the associated first and second pipes, and a fluid level sensor for each of said tanks for detecting the unloaded condition thereof, to accommodate the unloading of the associated railway tank car train the free end of the lading conduit at one end of the train being connected to the inlet for said container for fluid lading and the free end of the lading conduit at the other end of the train being connected to the outlet of said source of gas under pressure and the valve control mechanisms being connected to the control signal terminal of said terminal control system and the fluid level sensors being connected to the fluid level signal terminal of said terminal control system, an unload signal from the control signal terminal of said terminal control system actuating the valve control mechanism on the tank at the other end of the associated train to move the first and second control valves to the second positions thereof to close the associated lading conduit and to open the associated first and second pipes on the tank at the other end of the train and thus to remove the fluid lading therefrom through the lading conduit to the inlet of said container for fluid lading, detection of the unloaded condition of the tank at the other end of the train by the associated fluid level sensor providing a signal to the fluid level signal terminal of said terminal control system that in turn provides a signal from the control signal terminal thereof to the valve control mechanism on the next tank car in the train to move the first and second control valves thereof to the second positions to close the associated lading conduit between the first and second pipes and to open the first and second pipes on the next tank in the train and thus to remove the fluid lading from the tank in the train singly and in sequence from the other end of the train to the one end of the train, disconnection of said lading conduit from the inlet to said container for liquid lading and disconnection of the lading conduit from the outlet of said supply of gas under pressure and disconnection of the valve control mechanisms and the fluid level sensors from said terminal control system operating the first and second control valves to the first positions thereof closing the associated first and second pipes to place the railway tank car train in readiness for transporting.

60. The unloading system set forth in claim 59, wherein said terminal control system is electrically operated.

61. The unloading system set forth in claim 59, wherein the valve mechanisms are both pneumatically and electrically operated.

62. The unloading system set forth in claim 59, wherein each of said valve control mechanisms includes a first valve actuator for the associated first control valve and a second valve actuator for the associated second control valve, a solenoid control valve having an inlet for connection to a source of gas under pressure and a load outlet and an unload outlet selectively connectable to said inlet, an accumulator for compressed gases connected to said load outlet and said unload outlet for accumulating gas under pressure for operation of the associated valve actuators, a pilot valve connected to said load outlet and said accumulator and to said first and second valve actuators for selectively applying gas under pressure to said first and second valve actuators for controlling the positions thereof and the associated first and second control valves, and a connection between said unload outlet and said accumulator.

63. A railway tank car adapted for interconnection in fluid communication with associated like tank cars by flexible connecting conduits for singly and sequentially loading the tank cars with fluid lading and singly and sequentially unloading the tank cars of fluid lading, said tank car comprising a tank for holding fluid lading, a wheeled chassis structure mounting said tank with chassis coupling means for coupling to the chassis of associated like cars, a lading conduit on said tank extending substantially the length thereof and having coupling means on the ends thereof, said coupling means coupling to associated flexible connecting conduits to place said lading conduit in fluid communication with the lading conduits of adjacent like tank cars, a first control valve for selectively opening and closing said lading conduit, a first pipe in communication with said lading conduit on one side of said first control valve and extending into said tank and terminating at an open end adjacent to the bottom of said tank, a second control valve for selectively opening and closing said first pipe, a second pipe in communication with said lading conduit on the other side of said first control valve and extending into said tank, a third control valve for selectively opening and closing said second pipe, and valve control mechanism operatively connected to said control valves for closing said first control valve and opening said second and third control valves to accommodate loading of fluid lading into said tank and to accommodate unloading of fluid lading from said tank and for closing said first and second and third control valves for transporting of said tank, said valve control mechanism including a first valve actuator for said first control valve and a second valve actuator for said second control valve and a third valve actuator for said third control valve, a solenoid control valve having an inlet for connection to a source of gas under pressure and a load outlet and an unload outlet selectively connectable to said inlet, an accumulator for compressed gases connected to said load outlet and said unload outlet for accumulating gas under pressure for operation of said valve actuators, a first pilot valve connected to said unload outlet and said accumulator and to said first valve actuator for selectively applying gas pressure to said first valve actuator to control the position of said first control valve, and a second pilot valve connected to said load outlet and said accumulator and to said second and third valve actuators for selectively applying gas pressure to said second and third valve actuators for controlling the positions thereof and the associated second and third control valves.

64. A railway tank car adapted for interconnection in fluid communication with associated like tank cars by flexible connecting conduits for singly and sequentially loading the tank cars with fluid lading and singly and sequentially unloading the tank cars of fluid lading, said tank car comprising a tank for holding fluid lading, a wheeled chassis structure mounting said tank with chassis coupling means for coupling to the chassis of associated like cars, a lading conduit on said tank extending substantially the length thereof and having coupling means on the ends thereof, said coupling means coupling to associated flexible connecting conduits to place said lading conduit in fluid communication with the lading conduits of adjacent like tank cars, a first pipe in communication with said lading conduit extending into said tank and terminating at an open end adjacent to the bottom of said tank, a first control valve for opening and closing said lading conduit and said first pipe, a second pipe in communication with said lading conduit at a point spaced from said first pipe and extending into said tank, a second control valve for opening and closing said lading conduit and said second pipe, and valve control mechanism operatively connected to said control valves for actuating said control valves to close said lading conduit between said first and second pipes and to open said first and second pipes to accommodate loading of fluid lading into said tank and to accommodate unloading of fluid lading from said tank and for closing said first and second pipes for transporting of said tank, said valve control mechanism including a first valve actuator for said first control valve and a second valve actuator for said second control valve, a solenoid control valve having an inlet for connection to a source of gas under pressure and a load outlet and an unload outlet selectively connectable to said inlet, an accumulator for compressed gases connected to said load outlet and said unload outlet for accumulating gas under pressure for operation of said valve actuators, and a pilot valve connected to said load outlet and said accumulator and to said first and second valve actuators for selectively applying gas pressure to said first and second valve actuators for controlling the positions thereof and the associated first and second control valves, and a connection between said accumulator and said unload outlet.

65. A railway tank car train for singly and sequentially loading the tank cars with fluid lading and singly and sequentially unloading the tank cars of fluid lading, said train comprising a plurality of railway tank cars connected in tandem relationship, each of said tank cars including a tank for holding fluid lading, a wheeled chassis structure mounting each of said tanks with chassis coupling means for coupling said car together, a lading conduit on each of said tanks extending substantially the length thereof and having coupling means on the ends thereof, a plurality of flexible connecting conduits respectively extending between adjacent coupled ones of said tank cars and coupled to said coupling means on said lading conduits, a first control valve for selectively opening and closing the associated lading conduit, each of said tanks having a first pipe in communication with the associated lading conduit on one side of the associated first control valve and extending into said tank and terminating at an open end adjacent to the bottom thereof, a second control valve for selectively opening and closing the associated first pipe, each of said tanks having a second pipe in communication with the associated lading conduit on the other side of the associated first control valve and extending into said tank, a third control valve for selectively opening and closing the associated second pipe, and valve control mechanisms on each of said tanks operatively connected to the associated control valves for opening and closing the associated control valves, to accommodate the loading of said railway tank car train the free end of the lading conduit adjacent to the associated first pipe at one end of said train being connected to a source of fluid lading and said valve control mechanisms being actuated to close the associated first control valves and to open the associated second and third control valves and thereafter to fill the tank at said one end of said train and upon filling of the tank the associated valve control mechanism opening the associated first control valve and closing the associated second and third control valves to transfer the loading operation to the next tank in said train for loading in the same manner as the tank at said one end of said train until all of the tanks in said train have been loaded singly and in sequence from said one end of said train to the other end of said train, to accommodate the unloading of said railway tank car train the free end of the lading conduit at the one end of said train being connected to a container for the fluid lading and the free end of the lading conduit at the other end of said train being connected to a source of gas under pressure and all said valve control mechanisms are actuated to open all said first valves and said valve control mechanism for the tank at said other end of said train is actuated to close the associated first control valve and to open the associated second and third control valves on the tank at said other end of said train and thus to remove the fluid lading therefrom through said lading conduit and thereafter the valve control mechanism for the next tank in said train is actuated to close the associated first control valve and to open the associated second and third control valves for said next tank in said train and thus to remove the fluid lading from said tanks in said train singly and in sequence from said other end of said train to said one end of said train, for transporting of said train said valve control mechanisms then closing said second and said third control valves, each of said valve control mechanisms including a first valve actuator for the associated first control valve and a second valve actuator for the associated second control valve and a third valve actuator for the associated third control valve, a solenoid control valve having an inlet for connection to a source of gas under pressure and a load outlet and an unload outlet selectively connectable to said inlet, an accumulator for compressed gases connected to the associated load outlet and unload outlet for accummulating gas under pressure for operation of the associated valve actuators, a first pilot valve connected to the associated unload outlet and accumulator and to the associated first valve actuator for selectively applying gas pressure to the associated first valve actuator to control the position of the first control valve, and a second pilot valve connected to the associated load outlet and accumulator and the associated second and third control valves for selectively applying gas pressure to the associated second and third valve actuators for controlling the positions thereof and the associated second and third control valves.

66. A railway tank car train for singly and sequentially loading the tank cars with fluid lading and singly and sequentially unloading the tank cars of fluid lading, a plurality of railway tank cars connected in tandem relationship, each of said tank cars including a tank for holding fluid lading, a wheeled chassis structure mounting each of said tanks with chassis coupling means for coupling said cars together, a lading conduit on each of said tanks extending substantially the length thereof and having coupling means on the ends thereof, a plurality of flexible connecting conduits respectively extending between adjacent coupled ones of said tank cars and coupled to said coupling means on said lading conduits, each of said tanks having a first pipe in communication with the associated lading conduit and extending into said tank and terminating at an open end adjacent to the bottom thereof, a first control valve for opening and closing the associated lading conduit and the associated first pipe, each of said tanks having a second pipe in communication with the associated lading conduit at a point spaced from said first pipe and extending into said tank, a second control valve for opening and closing the associated lading conduit and the associated second pipe, and valve control mechanism operatively connected to said control valves for actuating said control valves to a first position opening the associated lading conduit and closing the associated first and second pipes and for actuating said control valves to a second position closing the associated lading conduit and opening the associated first and second pipes, to accommodate the loading of said railway tank car train the free end of the lading conduit adjacent to the associated first pipe at one end of said tank train being connected to a source of fluid lading and said valve control mechanism on the tank car at said one end of said train is actuated to move said first and second control valves to the second positions thereof to close the associated lading conduit and to open the associated first and second pipes and thus to fill the tank at said one end of said train and upon filling of the tank the associated valve control mechanism actuating the associated first and second control valves to the first positions thereof to open the associated lading conduit and to close the associated first and second pipes and to transfer the loading operation to the next tank in said train for loading in the same manner as the tank at said one end of said train until all the tanks in said train have been loaded singly and in sequence from said one end of said train to said other end of said train, to accommodate the unloading of said railway tank car train the free end of the lading conduit at the one end of said train being connected to a container for the fluid lading and the free end of the lading conduit at the other end of said train being connected to a source of gas under pressure and said valve control mechanism for the last tank on the other end of said train is actuated to move said first and second control valves to the second positions thereof to close said lading conduit and to open said first and second pipes on the last tank at said other end of said train and thus to remove the fluid lading therefrom through said lading conduit and thereafter the valve control mechanism for the next tank in said train is actuated to move said first and second control valves to the second positions thereof to close the associated lading conduit and to open said first and second pipes on said next tank in said train and thus to remove the fluid lading from said tanks in said train singly and in sequence from said other end of said train to said one end of said train, for transporting of said train said valve control mechanisms operating said first and second control valves to the first positions thereof closing said first and second pipes, each of said valve control mechanisms including a first valve actuator for the associated first control valve and a second valve actuator for the associated second control valve, a solenoid control valve having an inlet for connection to a source of gas under pressure and a load outlet and an unload outlet selectively connectable to said inlet, an accumulator for compressed gases connected to said load outlet and said unload outlet for accumulating gas under pressure for operation of the associated valve actuators, a pilot valve connected to said load outlet and said accumulator and to said first and second valve actuators for selectively applying air pressure to said first and second valve actuators for controlling the positions thereof and the associated first and second control valves, and a connection between said unload outlet and said accumulator.

* * * * *